US011205332B2

(12) United States Patent
Copperman

(10) Patent No.: US 11,205,332 B2
(45) **Date of Patent: *Dec. 21, 2021**

(54) VEHICLE-MOUNTABLE CHILD PROTECTIVE DEVICE

(71) Applicant: BABY FLAG LTD., Jerusalem (IL)

(72) Inventor: Gideon Copperman, Jerusalem (IL)

(73) Assignee: BABY FLAG LTD., Jerusalem (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/989,031

(22) Filed: Aug. 10, 2020

(65) Prior Publication Data

US 2020/0402382 A1 Dec. 24, 2020

Related U.S. Application Data

(63) Continuation of application No. 16/473,009, filed as application No. PCT/IL2018/050079 on Jan. 22, 2018, now Pat. No. 10,818,154.

(30) Foreign Application Priority Data

Mar. 6, 2017 (IL) ..... 250956

(51) Int. Cl.
*G09F 17/00* (2006.01)
*G08B 21/02* (2006.01)
(Continued)

(52) U.S. Cl.
CPC ..... *G08B 21/0216* (2013.01); *G08B 7/00* (2013.01); *G08B 21/24* (2013.01); *G09F 17/00* (2013.01);
(Continued)

(58) Field of Classification Search
CPC ..... G08B 21/0216; G08B 7/00; G08B 21/24; G09F 17/00; G09F 2017/0025; G09F 2017/0075; G09F 2017/0083
See application file for complete search history.

(56) References Cited

U.S. PATENT DOCUMENTS 3,715,821 A 2/1973 Hawes
3,762,360 A * 10/1973 Hawes ..... B60Q 7/005 116/28 R
(Continued)

FOREIGN PATENT DOCUMENTS

FR 2823477 10/2002
JP 2002-109655 4/2002
(Continued)

OTHER PUBLICATIONS

An Office Action dated Feb. 11, 2021, which issued during the prosecution of U.S. Appl. No. 17/016,932.
(Continued)

*Primary Examiner* — Munear T Akki
(74) *Attorney, Agent, or Firm* — Sughrue Mion, PLLC

(57) ABSTRACT

A vehicle-mountable child protective device including a housing which is mountable onto a door of a vehicle and including a first housing portion, which is at least partially located within the vehicle when the device is mounted onto the vehicle and during device operation, and a second housing portion, which is at least partially located outside the vehicle when the device is mounted onto the vehicle and during device operation, a flag which is rotatably mounted via a flagpole onto the first housing portion and a flag positioning assembly at least partially within the first housing portion for automatically rotating the flag to a raised position outside of and above the vehicle upon opening of the door of the vehicle.

14 Claims, 37 Drawing Sheets

(51) Int. Cl.
*G08B 21/24* (2006.01)
*G08B 7/00* (2006.01)

(52) U.S. Cl.
CPC ..... *G09F 2017/0025* (2013.01); *G09F 2017/0075* (2013.01); *G09F 2017/0083* (2013.01)

(56) References Cited

U.S. PATENT DOCUMENTS

| | | | | |
|---|---|---|---|---|
| 4,052,697 | A | 10/1977 | Daifotes | |
| 4,178,874 | A * | 12/1979 | Berns | G09F 21/048 116/28 R |
| 4,565,152 | A | 1/1986 | Bennett | |
| 4,833,443 | A * | 5/1989 | Siew | B60Q 1/503 116/173 |
| 5,038,136 | A * | 8/1991 | Watson | B60Q 1/50 340/480 |
| 5,249,381 | A * | 10/1993 | Panossian | G09F 21/04 40/591 |
| 5,305,704 | A * | 4/1994 | Olaniyan | B60Q 1/482 362/540 |
| 5,382,953 | A | 1/1995 | Hauptli | |
| 5,635,902 | A * | 6/1997 | Hochstein | B60Q 1/2692 340/433 |
| 6,010,107 | A * | 1/2000 | Goldfarb | B60Q 1/50 116/28 R |
| 6,178,676 | B1 * | 1/2001 | Lund | B60Q 1/50 116/63 T |
| 6,276,080 | B1 * | 8/2001 | Brennan | B60Q 1/268 116/63 T |
| 6,337,623 | B1 | 1/2002 | Krugh, IV et al. | |
| D475,677 | S * | 6/2003 | Zucker | D12/223 |
| 6,825,760 | B2 * | 11/2004 | Sawyer | B60K 28/02 116/28 R |
| 6,922,147 | B1 | 7/2005 | Viksnins et al. | |
| 7,642,906 | B1 | 1/2010 | McMurrer | |
| 7,992,333 | B1 * | 8/2011 | McGuinness | G09F 7/18 40/591 |
| 8,058,983 | B1 | 11/2011 | Davisson et al. | |
| 8,368,560 | B2 | 2/2013 | McDonald | |
| 9,691,250 | B2 | 6/2017 | Trang | |
| 10,818,154 | B2 | 10/2020 | Copperman | |
| 10,832,549 | B1 | 11/2020 | Copperman | |
| 2008/0282964 | A1 | 11/2008 | Bennett | |
| 2009/0007959 | A1 | 1/2009 | Wu et al. | |
| 2009/0199762 | A1 * | 8/2009 | Elam | B60Q 7/00 116/28 R |
| 2014/0174334 | A1 * | 6/2014 | Tucker | G09F 17/00 116/173 |
| 2014/0253314 | A1 | 9/2014 | Rambadt et al. | |
| 2014/0302764 | A1 | 10/2014 | Wu et al. | |
| 2016/0280126 | A1 | 9/2016 | Tanaka | |
| 2017/0043714 | A1 | 2/2017 | Lewis-cheeks | |
| 2018/0033277 | A1 | 2/2018 | Entis | |
| 2019/0215672 | A1 | 7/2019 | Orris et al. | |
| 2019/0385431 | A1 | 12/2019 | Copperman | |

FOREIGN PATENT DOCUMENTS

| | | |
|---|---|---|
| KR | 20140132605 | 11/2014 |
| KR | 20160037385 | 4/2016 |
| WO | 2018/163146 | 9/2018 |

OTHER PUBLICATIONS

An International Search Report and a Written Opinion both dated May 4, 2018, which issued during the prosecution of Applicant's PCT/IL2018/050079.

An International Preliminary Report on Patentability dated Sep. 10, 2019, which issued during the prosecution of Applicant's PCT/IL2018/050079.

An English Translation of an Office Action dated Aug. 30, 2017, which issued during the prosecution of Israel Patent Application No. 250956. (the relevant part only).

An Office Action dated May 22, 2020, which issued during the prosecution of U.S. Appl. No. 16/538,101.

Notice of Allowance dated Sep. 24, 2020, which issued during the prosecution of U.S. Appl. No. 16/538,101.

Notice of Allowance dated Jul. 7, 2020, which issued during the prosecution of U.S. Appl. No. 16/538,101.

Notice of Allowance dated Jun. 26, 2020, which issued during the prosecution of U.S. Appl. No. 16/473,009.

Notice of Allowance dated May 28, 2020, which issued during the prosecution of U.S. Appl. No. 16/473,009.

Notice of Allowance dated Sep. 23, 2020, which issued during the prosecution of U.S. Appl. No. 16/473,009.

An Office Action dated Feb. 27, 2020, which issued during the prosecution of U.S. Appl. No. 16/473,009.

European Search Report dated Jun. 26, 2020, which issued during the prosecution of Applicant's European App No. 18764494.3.

An International Search Report and a Written Opinion both dated Sep. 16, 2020, which issued during the prosecution of Applicant's PCT/IL2020/050797.

* cited by examiner

VEHICLE-MOUNTABLE CHILD PROTECTIVE DEVICE

REFERENCE TO RELATED APPLICATIONS

The present application is a continuation application of U.S. patent application Ser. No. 16/473,009, filed Jun. 24, 2019, entitled "VEHICLE-MOUNTABLE CHILD PROTECTIVE DEVICE", now U.S. Pat. No. 10,818,154, which is a National Phase Application of International Patent Application No. PCT/IL2018/050079, filed Jan. 22, 2018, entitled "VEHICLE-MOUNTABLE CHILD PROTECTIVE DEVICE", which claims priority of Israel Patent Application Serial No. 250956 entitled VEHICLE-MOUNTABLE CHILD PROTECTIVE DEVICE, filed Mar. 6, 2017, the disclosures of which are hereby incorporated by reference.

FIELD OF THE INVENTION

The present invention relates generally to child safety devices and more particularly to devices for providing an alert if a child is inadvertently left in a vehicle.

BACKGROUND OF THE INVENTION

Various devices are known for providing an alert if a child is inadvertently left in a vehicle.

SUMMARY OF THE INVENTION

The present invention seeks to provide an improved device for providing an alert if a child is inadvertently left in a vehicle.

There is thus provided in accordance with a preferred embodiment of the present invention a vehicle-mountable child protective device including a housing which is mountable onto a door of a vehicle and including a first housing portion, which is at least partially located within the vehicle when the device is mounted onto the vehicle and during device operation, and a second housing portion, which is at least partially located outside the vehicle when the device is mounted onto the vehicle and during device operation, a flag which is rotatably mounted via a flagpole onto the first housing portion and a flag positioning assembly at least partially within the first housing portion for automatically rotating the flag to a raised position outside of and above the vehicle upon opening of the door of the vehicle.

In accordance with a preferred embodiment of the present invention the vehicle mountable child protective device also includes a solar energy generating array mounted on the second housing portion and being exposed to solar radiation from outside the vehicle.

Preferably, the first housing portion also includes a vehicle window mounting portion for enabling mounting of the housing onto the vehicle.

In accordance with a preferred embodiment of the present invention the flag positioning assembly includes at least one flag positioning spring urging the flag positioning assembly to rotate the flag to the raised position. Additionally, the flag positioning assembly is manually operable by a user for rotating the flag from the raised position to a lowered position. Additionally, vehicle-mountable child protective device also includes electronic circuitry operative to provide a user-sensible warning to a user who is located at a distance greater than a predetermined distance from the vehicle when the flag is in the raised position.

In accordance with a preferred embodiment of the present invention the vehicle-mountable child protective device also includes temperature exceedance electronic circuitry operative to provide an audible warning when a temperature within the vehicle is greater than a predetermined threshold, when the flag is in the raised position. Additionally, the temperature exceedance electronic circuitry includes a sound generator, a magnet propinquity sensor, and a push button for disabling operation of the sound generator.

In accordance with a preferred embodiment of the present invention the flag positioning assembly is operative for preventing rotating of the flag from the raised position to the lowered position without first opening of the door of the vehicle. Additionally or alternatively, the flag positioning assembly is configurable for selectable manual rotation of the flag from the raised position to the lowered position in mutually opposite rotational directions.

Preferably, the flag positioning assembly includes the flagpole, which is rotatably mounted onto the first housing portion for selectable rotational positioning thereof and a magnet, mounted on a bottom of the flagpole, the magnet being operative to provide an electronically sensible indication of rotational position of the flagpole. Additionally or alternatively, the at least one flag positioning spring includes a pair of flag positioning coil springs, each of which urges the flag to the raised position from the lowered position.

In accordance with a preferred embodiment of the present invention the flag positioning assembly includes a cover member, which is pivotably mounted onto the first housing portion for rotation with respect thereto, the cover member having an open raised operative orientation and a closed lowered operative orientation.

Preferably, the cover member is normally urged to the open raised operative orientation and is operative when in the closed lowered operative orientation and the flagpole is in the raised position to retain the flagpole in the upright position. Additionally or alternatively, the cover member is operative when in the closed lowered operative orientation and the flagpole is in the lowered position to retain the flagpole in the lowered position.

In accordance with a preferred embodiment of the present invention the cover member is associated with a vehicle engagement pad for engaging a side panel of the vehicle when the door of the vehicle is closed, forcing the cover member to the closed lowered operative orientation.

In accordance with a preferred embodiment of the present invention the flag positioning assembly includes a retaining pin which is also operative to selectably retain the flag in another lowered position, even when the cover member is in the open raised operative orientation. Additionally, the flag positioning assembly is operative such that a first angular orientation of the flag, when the flag is retained in the another lowered position by the retaining pin, is slightly lower than a second angular orientation of the flag, when the flag is retained in the lowered position by the cover member.

Preferably, the flag positioning assembly includes a retaining spring clip, which engages the retaining pin, and a retaining pin coil spring which surrounds part of the retaining pin and urges the retaining pin into a forward engaged axial position relative to the first housing element in which the retaining pin does not rotationally lock the flagpole. Additionally, the retaining pin defines a cover member engagement end and a flange at an end of the retaining pin opposite to the cover member engagement end.

In accordance with a preferred embodiment of the present invention, in a first operative orientation of the device, at least one of the at least one flag positioning spring is tensioned and the flagpole is in a first lowered operative orientation against the urging of the at least one of the at least one flag positioning spring, which is tensioned, by engagement of a locking surface of a cam riding protrusion of the retaining pin with a radially-extending locking engagement surface of a circumferentially extending inclined cam surface of the first housing portion. Additionally, in a second operative orientation of the device, the flagpole is retained in a second lowered operative orientation by engagement of a flagpole engagement edge of a lowered flagpole engaging protrusion of the cover member with the flagpole, when the cover member is maintained in the closed lowered operative orientation either by being manually held in the closed lowered operative orientation by a user or when the device is mounted on a closed window of the door of the vehicle and the door is closed. Preferably, the cover member is rotated to the closed lowered operative orientation and a pin engagement protrusion thereof is in engagement with a cover member engagement end of the pin, the pin is linearly displaced, against the urging of the retaining pin coil spring to a position in which the cam riding protrusion of the retaining pin is disengaged from the circumferentially extending inclined cam surfaces of the first housing element.

In accordance with a preferred embodiment of the present invention, in a third operative orientation of the device, the flagpole is rotated to a raised operative orientation by urging of the at least one of the at least one flag positioning spring and the cover member is enabled to assume the open raised operative orientation, when mounted on a closed window of the door of the vehicle and the door of the vehicle is opened. Additionally, when the cover member is rotated to the open raised operative orientation and the pin engagement protrusion thereof is no longer in engagement with the cover member engagement end of the retaining pin, the retaining pin is linearly displaced, under the urging of the retaining pin coil spring to a position in which the cam riding protrusion of the retaining pin is located between inclined surfaces of oppositely directed circumferentially extending inclined cam surfaces of the first housing portion.

In accordance with a preferred embodiment of the present invention, in a fourth operative orientation of the device, the flagpole is retained in the raised operative orientation by rotation of the cover member to the closed lowered operative orientation and the pin engagement protrusion of the cover member is in engagement with the cover member engagement end of the retaining pin, such that upon rotation of the cover member to the closed lowered operative orientation, the retaining pin is linearly displaced, against the urging of the retaining pin coil spring to a position in which the cam riding protrusion of the retaining pin is disengaged from the circumferentially extending inclined cam surfaces of the first housing portion. additionally, the flagpole is retained in the raised operative orientation by being located in an upright flagpole retaining slot of the cover member and cannot be lowered from the raised operative orientation without opening the door of the vehicle.

Preferably, in a fifth operative orientation of the device, the cover member is in the open raised operative orientation and no longer prevents manual rotation of the flagpole to the second lowered operative orientation. Additionally, the flagpole is no longer retained in the raised operative orientation by being located in the upright flagpole retaining slot of the cover member and when the cover member is rotated to the open raised operative orientation and the pin engagement protrusion thereof is no longer in engagement with the cover member engagement end of the retaining pin, the retaining is linearly displaced, under the urging of the retaining pin coil spring, to a position in which the cam riding protrusion of the retaining pin is located between the inclined surfaces of the oppositely directed circumferentially extending inclined cam surfaces of the first housing portion.

In accordance with a preferred embodiment of the present invention the vehicle-mountable child protective device is mountable onto the top edge of a window of the door of the vehicle and system electronics of the vehicle-mountable child protective device and a user-carryable remote controller are in an OFF or sleep mode state. Additionally, upon a user subsequently closing the window, and thereafter closing the door of the vehicle, the cover member is retained in its closed lowered operative orientation, retaining the flagpole in the second lowered operative orientation.

Preferably, when the door of the vehicle is opened with the vehicle-mountable child protective device mounted on the door of the vehicle, opening of the door of the vehicle causes the flagpole to automatically rotate to the raised position in which the flag is positioned above a level of a roof of the vehicle. Additionally, rotation of the flagpole to the raised operative orientation activates the user-carryable remote controller and sends a system electronics activation notification to the user-carryable remote controller.

Preferably, when the flagpole is in the raised operative orientation, the system electronics periodically transmits a "flag raised" signal to the user-carryable remote controller. Additionally or alternatively, once activated, the user-carryable remote controller awaits a flag raised signal from the system electronics and in the absence of a received flag raised signal, which absence indicates that the user has left the immediate vicinity of the vehicle, the user-carryable remote controller provides a user-sensible indication, thereby ensuring that once the flag is raised the user is reminded not to leave the vicinity of the vehicle without either reopening the vehicle door or taking other action to terminate the user-sensible indication.

In accordance with a preferred embodiment of the present invention the system electronics, once activated and until deactivated by lowering of the flag, conducts a vehicle interior temperature check and in the event of exceedance of a threshold temperature at the vehicle interior provides an audible alarm.

BRIEF DESCRIPTION OF THE DRAWINGS

The present invention will be understood and appreciated more fully from the following detailed description in which.

DETAILED DESCRIPTION OF PREFERRED EMBODIMENTS

Figure 1A:
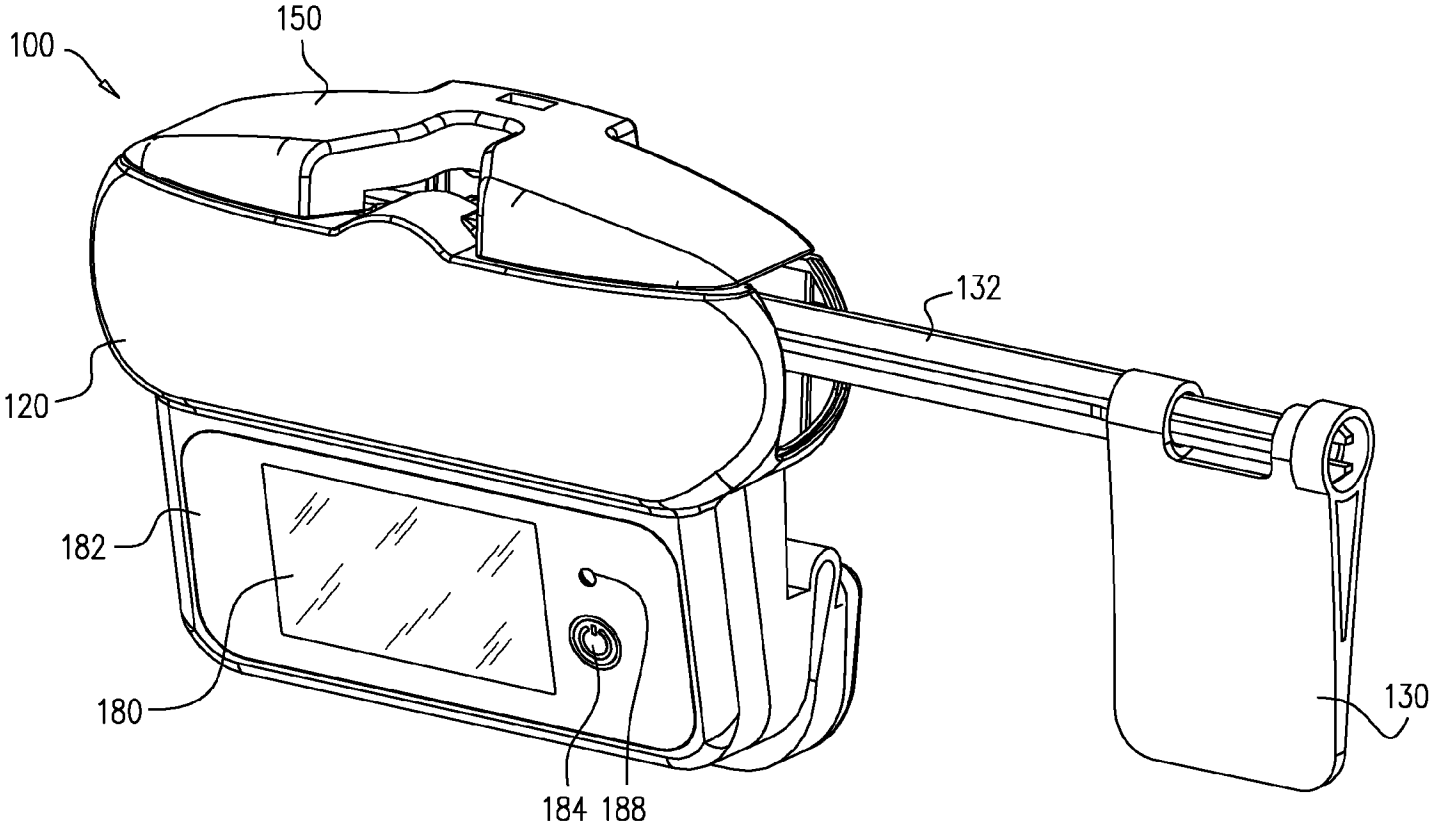
FIGS. 1A and 1B are simplified pictorial illustrations, taken in mutually opposite directions, of a vehicle-mountable child protective device constructed and operative in accordance with a preferred embodiment of the present invention in a first operative orientation.
Figure 1B:
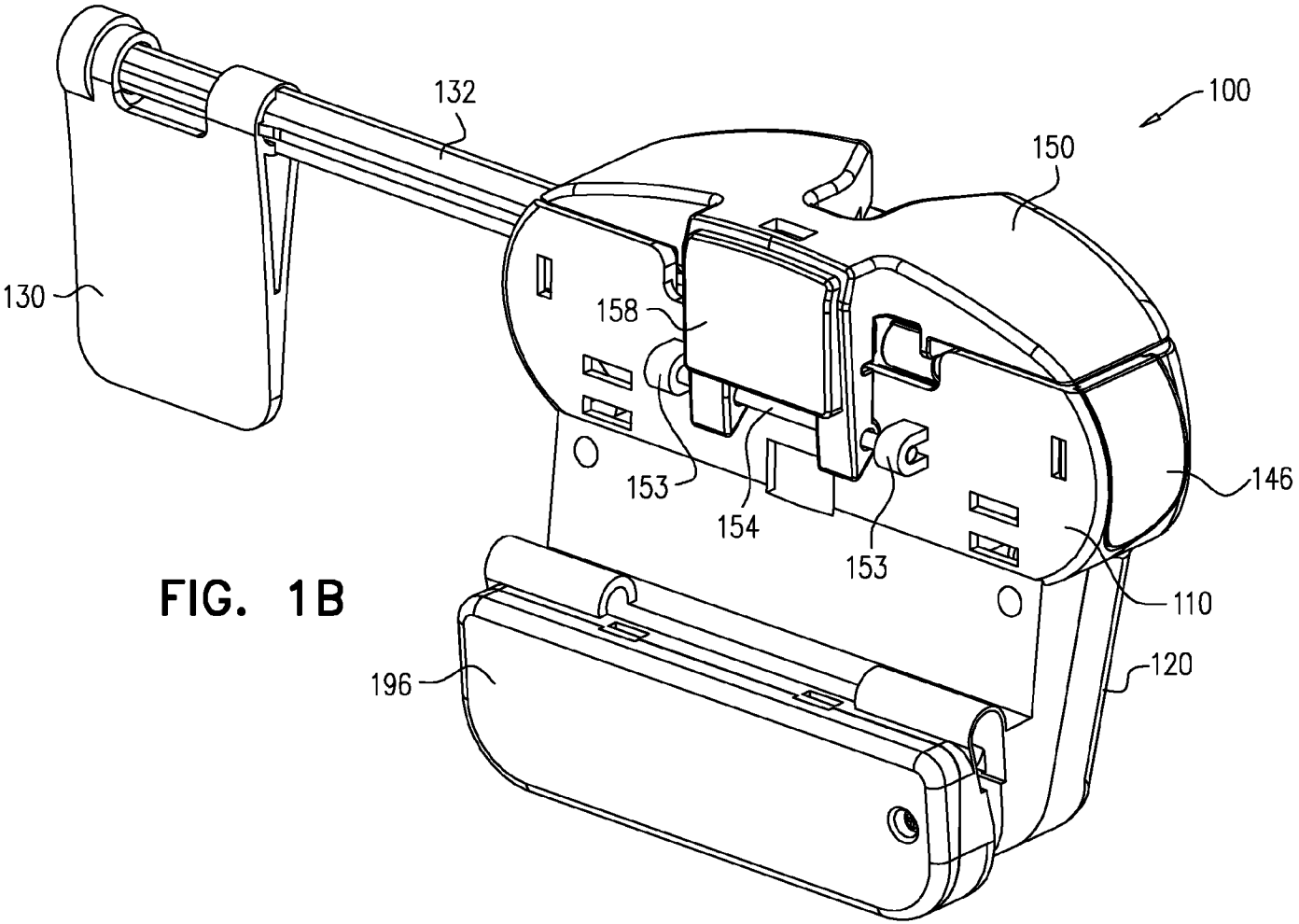
Figure 1C:
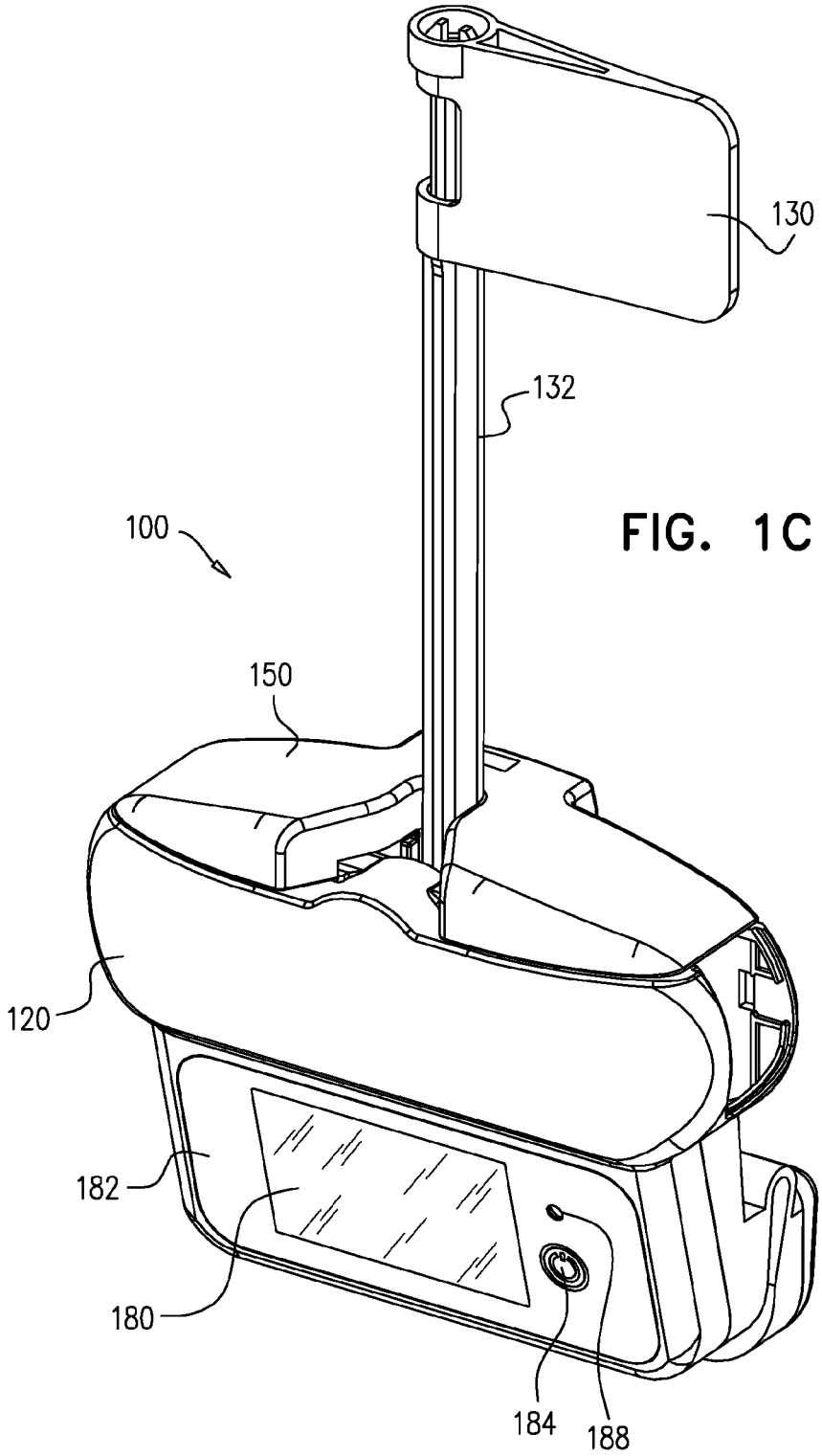
FIGS. 1C and 1D are simplified pictorial illustrations, taken in mutually opposite directions, of the vehicle-mountable child protective device of FIGS. 1A & 1B in a second operative orientation.
Figure 1D:
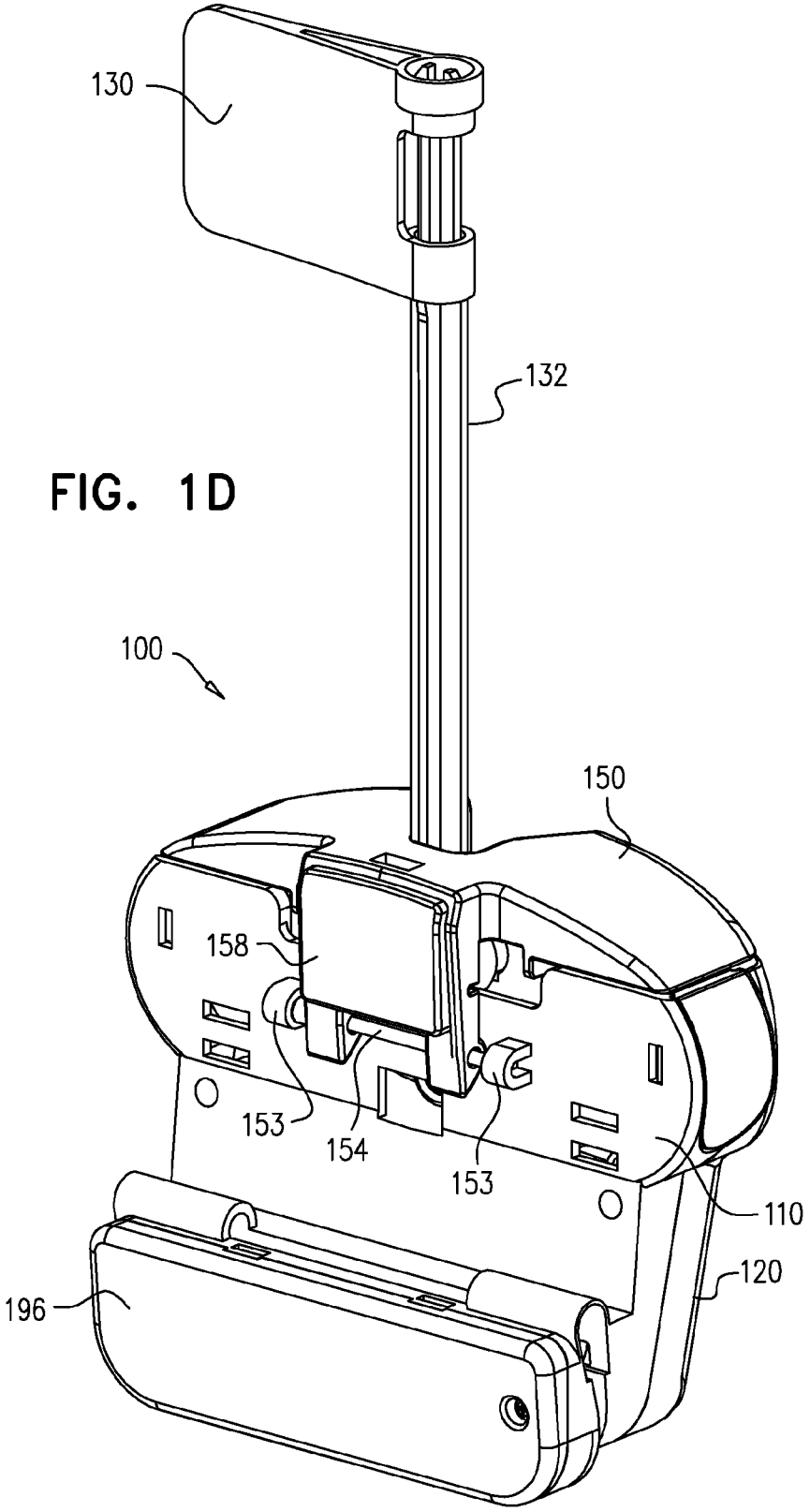

Reference is now made to FIGS. 1A-2B, which are simplified illustrations of a vehicle-mountable child protective device 100, constructed and operative in accordance with a preferred embodiment of the present invention.

As seen in FIGS. 1A-2B, the vehicle-mountable child protective device 100 preferably includes a housing which is mountable onto a vehicle door, preferably as described hereinbelow in detail with reference to FIGS. 21A-21I, and includes a first housing portion 110, which is at least partially located within the vehicle during operation of the device, and a second housing portion 120, which is at least partially located outside the vehicle when the device 100 is mounted onto the vehicle.

A flag 130 is supported by a flagpole 132, which is rotatably mounted onto first housing portion 110 for selectable rotational positioning thereof about an axis 134. Preferably, a magnet 135 is mounted on a bottom of flagpole 132 and is partially enclosed by a cover 136. Magnet 135 is operative to provide an electronically sensible indication of the position of the flagpole, which indication is employed by electronic circuitry described hereinbelow with reference to FIG. 20.

A flag positioning assembly 140, located at least partially within first housing portion 110 and at least partially between first and second housing portions 110 and 120, is operative for automatically rotating the flagpole 132 and thus the flag 130 to a raised position outside of and above the vehicle upon opening of the door onto which the device 100 is mounted.

The flag positioning assembly 140 preferably includes a pair of flag positioning coil springs 142 and 144, each of which urges the flagpole 132 and the flag 130 to an upright operative orientation from a lowered operative orientation. The flagpole 132 and the flag 130 may have two opposite lowered operative orientations, each typically at approximately 90 degrees to the upright operative orientation. Flag positioning coil spring 142 is operative to urge the flagpole 132 and the flag 130 to the upright operative orientation from a first lowered operative orientation and flag positioning coil spring 144 is operative to urge the flagpole 132 and the flag 130 to the upright operative orientation from a second lowered operative orientation. A side cover member 146 is preferably mounted onto first and second housing portions 110 and 120 at edges thereof opposite to the edge between which the flagpole 132 extends when in a lowered operative orientation.

The flag positioning assembly 140 also preferably includes a cover member 150 which is pivotably mounted onto first housing portion 110 for rotation about an axis 152 defined by a pair of protrusions 153 integrally formed with first housing portion 110, which support an axle 154. Cover member 150 is normally urged to an open raised operative orientation by a pair of springs 156 which are preferably mounted onto axle 154. Cover member 150 is operative when in a closed lowered operative orientation and the flagpole 132 is in an upright operative orientation to retain the flagpole 132 in the upright operative orientation. Cover member 150 is also operative when in the closed lowered operative orientation and the flagpole 132 is in a lowered operative orientation to retain the flagpole 132 in the lowered operative orientation. A vehicle engagement pad 158 is preferably mounted on a rearward-facing (in the sense of FIG. 2A) surface of cover member 150 and includes forward-facing snap-fit locating protrusions 159.

The flag positioning assembly 140 also preferably includes a retaining pin 160 which is also operative to selectably retain the flagpole 132 and the flag 130 in a lowered position, even when the cover member 150 is in the open raised operative orientation. It is noted that the angular orientation of the flagpole 132 and the flag 130 when retained in a lowered position by retaining pin 160 is different from and preferably slightly lower than the angular orientation of the flagpole 132 and the flag 130 when retained in a lowered position by the cover member 150. A retaining spring clip 162 preferably engages retaining pin 160. A retaining pin coil spring 163 is partially seated within a recess formed in flagpole 132 and surrounds part of pin 160. Retaining pin coil spring 163 urges pin 160 into a forward engaged axial position relative to the first housing element 110 in which the pin does not rotationally lock the flagpole 132. Retaining pin 160 preferably defines a cover member engagement end 164 and a flange 166 at an end of pin 160 opposite to cover member engagement end 164.

Disposed between the first and second housing portions 110 and 120 are preferably an electronics enclosure element 170, which encloses a PCB 172 which preferably embodies the system electronics, the functionality of which is described hereinbelow with reference to FIG. 20. The PCB 172 includes, inter alia, a sound generator 174, a magnet propinquity sensor 175 and a push button 176 for disabling operation of the sound generator 174.

Preferably located on an outer-facing surface of the second housing portion 120 is a solar energy generating array 180 and an environmentally protected face plate 182, including a flexible portion 184 for enabling user operation of push button 176 mounted on PCB 172. Environmentally protected face plate 182 preferably includes an aperture 188 permitting sound transmission therethrough of an aural alarm indication from sound generator 174, mounted on PCB 172.

A battery 190 is preferably mounted on first housing portion 110 as is a PCB 192, preferably having mounted thereon a temperature sensor 194. A vehicle interior-facing panel 196 is preferably removably mountable on first housing portion 110 over PCB 192 and battery 190.

Reference is now made to FIGS. 3A-4B, which illustrate first housing portion 110. As seen in FIGS. 3A-4B, the first housing portion is preferably an integrally formed element and preferably includes a base portion 210 including an outwardly-facing (forwardly-facing in the sense of FIG. 3A) recess 212 defining an upper outwardly-facing planar surface 214 and a lower outwardly-facing planar surface 216, inwardly recessed with respect thereto. A pair of assembly bosses 218 are preferably formed on upper planar surface 214. A pair of attachment clips 219 are preferably formed on lower outwardly-facing planar surface 216.

Figure 2A:
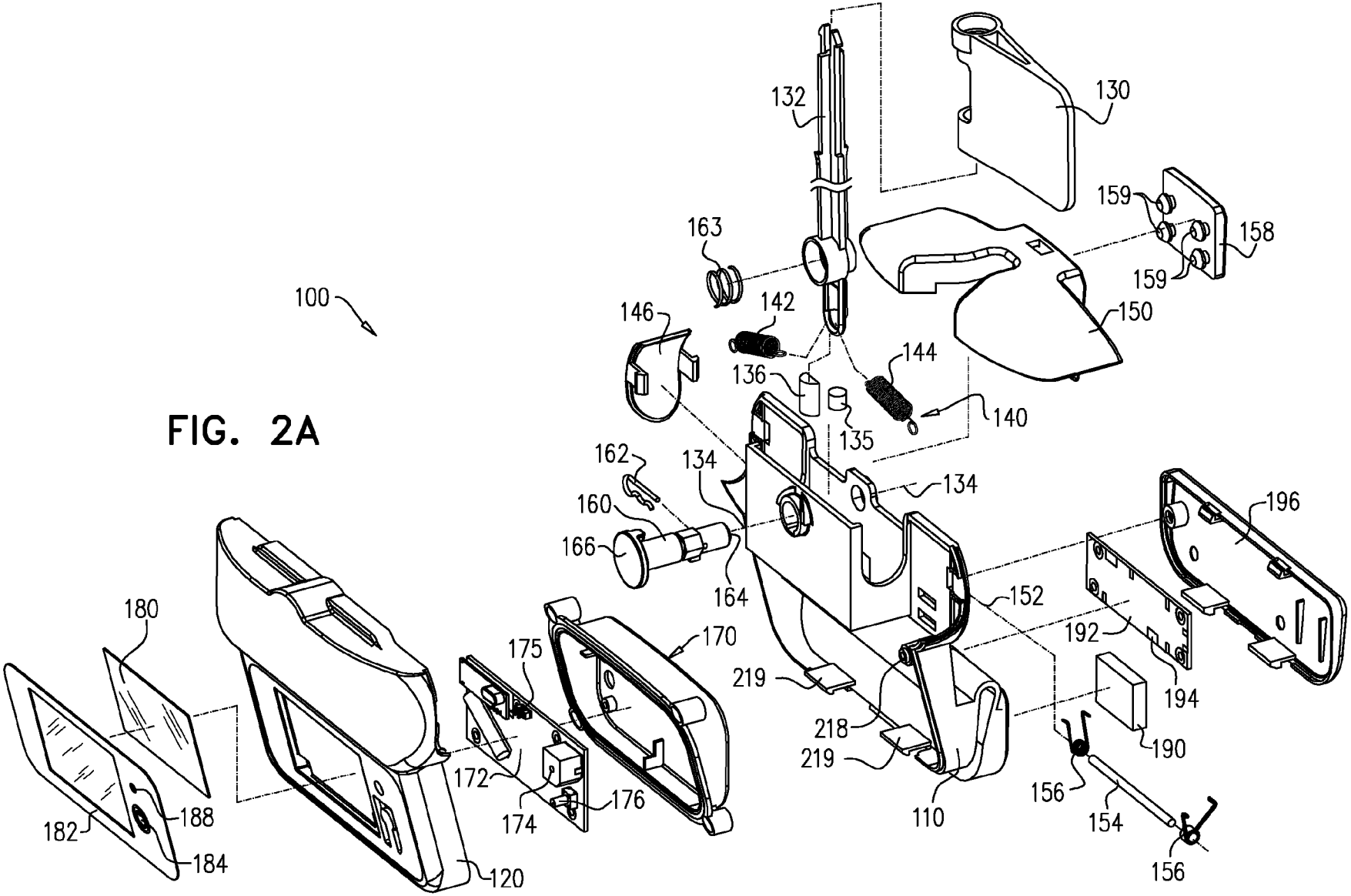
FIGS. 2A and 2B are simplified exploded view illustrations, taken in mutually opposite directions, of the vehicle-mountable child protective device of FIGS. 1A-1D.
Figure 2B:
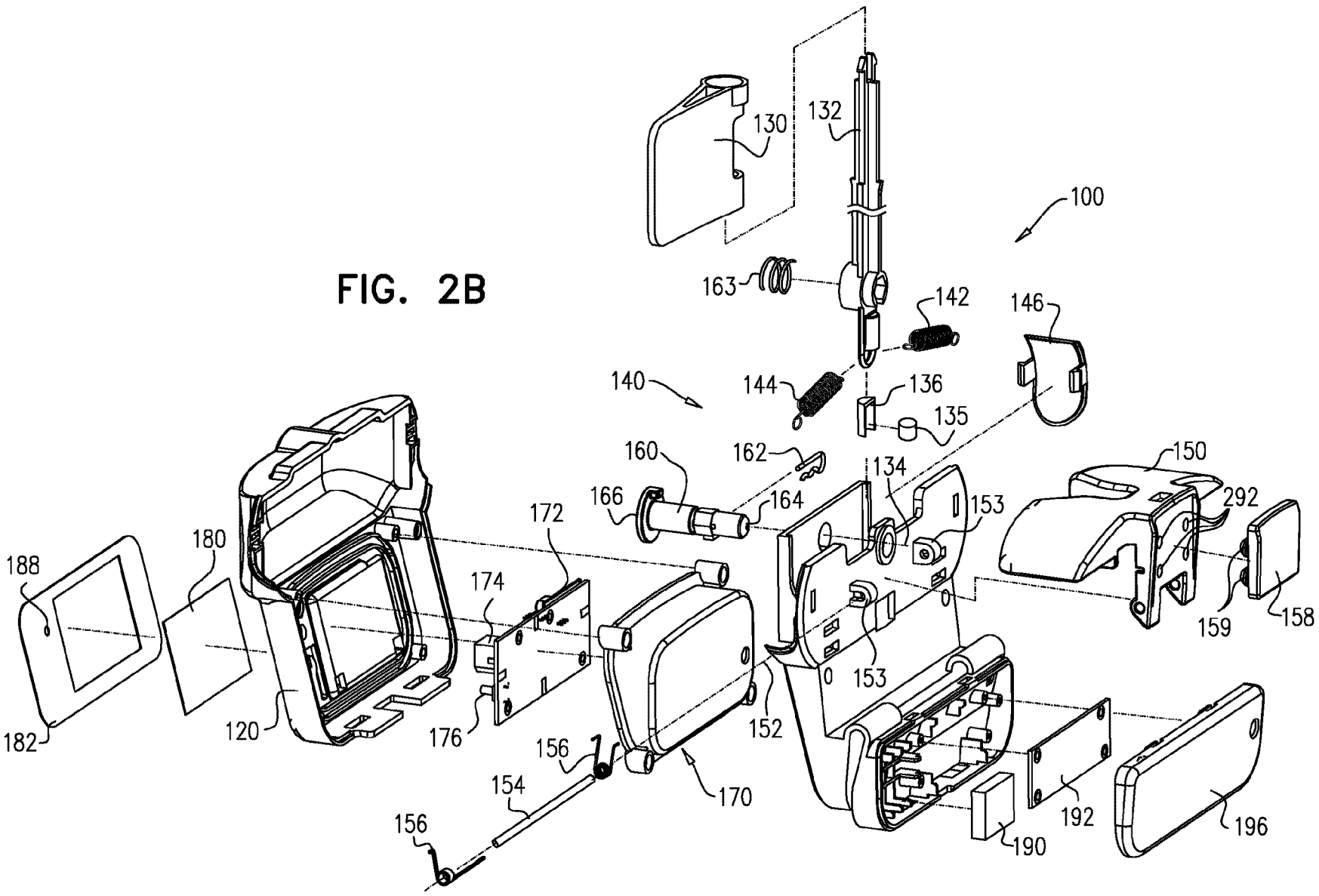
Figure 3A:
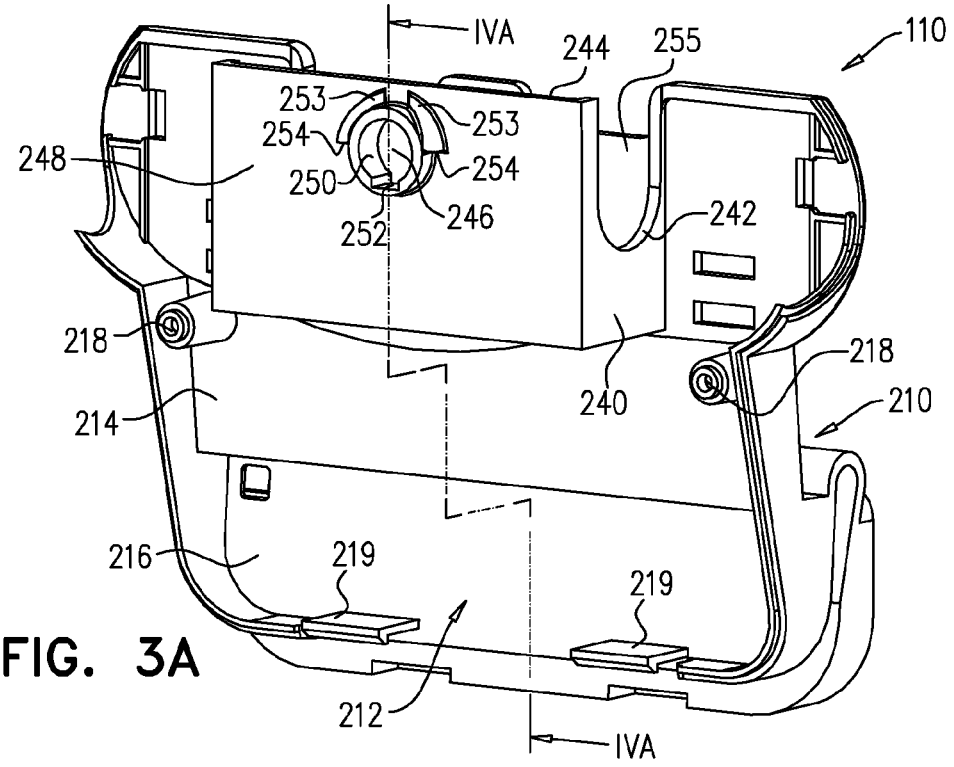
FIGS. 3A and 3B are simplified pictorial illustrations, taken in mutually opposite directions, of a vehicle interior-facing housing portion of the vehicle-mountable child protective device of FIGS. 1A-2B.
Figure 3B:
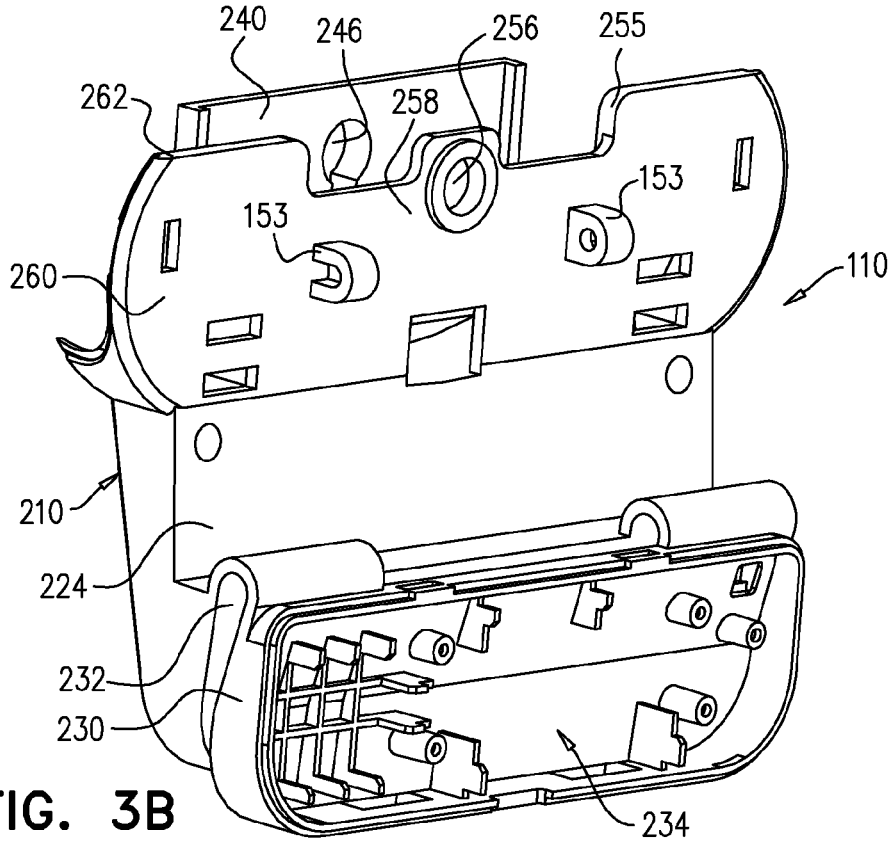
Figure 4A:
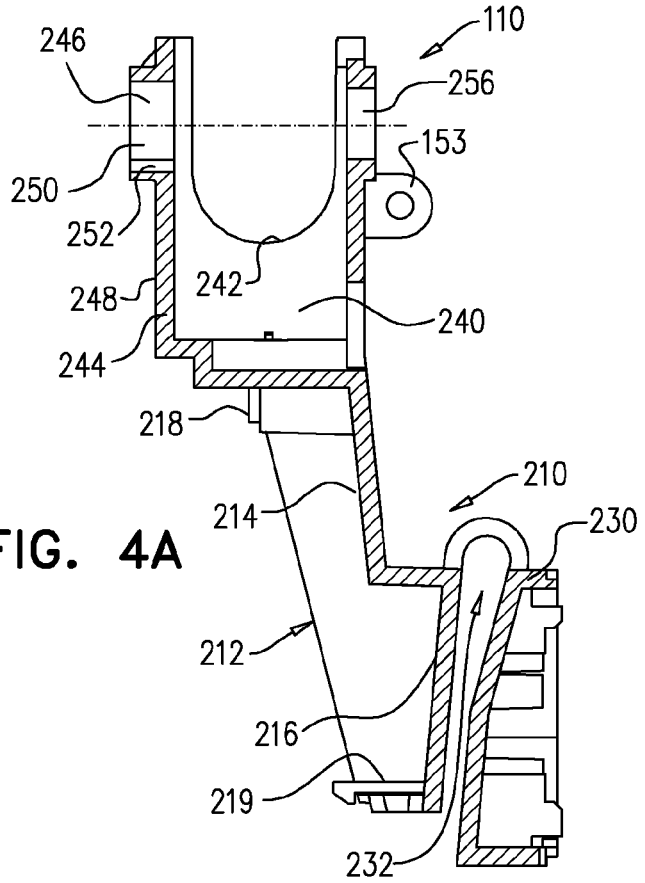
FIGS. 4A and 4B are simplified respective sectional and top view illustrations of the vehicle interior-facing housing portion of FIGS. 3A and 3B, FIG. 4A being taken along lines IVA-IVA in FIG. 3A.
Figure 4B:
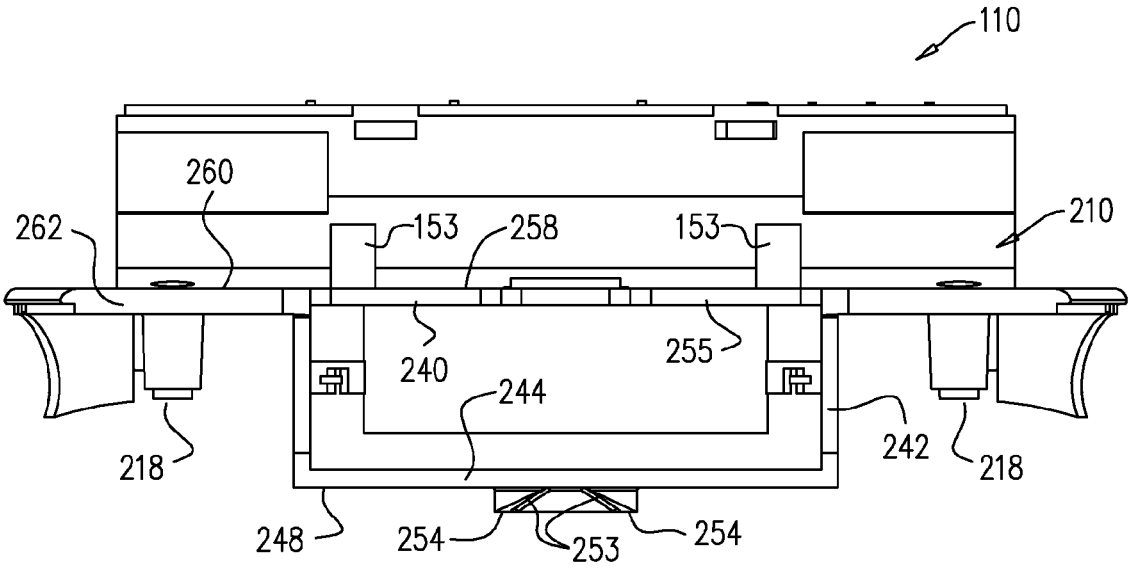

Base portion 210 preferably defines an upper inwardly-facing planar surface 224 and therebelow, a folded over top window edge engagement portion 230 defining a resilient window engagement slot 232 and defining, on a rearward surface thereof, a recess 234, which accommodates battery 190 and PCB 192 and is covered by cover 196 (FIGS. 2A and 2B).

First housing portion 110 also defines, above base portion 210, a generally rectangular enclosure 240 for flag positioning assembly 140. Enclosure 240 defines cut outs 242 for accommodating flagpole 132 when it is in a lowered position. One of cut outs 242, through which it is not intended that flagpole 132 extend, is preferably covered by side cover member 146. Enclosure 240 is formed with an outer facing wall 244 having an aperture 246 for accommodating retaining pin 160. Surrounding aperture 246 on an outer facing surface 248 of wall 244 is a cylinder 250 having a slot 252 formed therein and being at least partially surrounded by a pair of mutually spaced, oppositely directed, circumferentially extending inclined cam surfaces 253, each having a radially-extending locking engagement surface 254.

A rear wall 255 of enclosure 240 defines an aperture 256, which is coaxial with aperture 246, and defines a rear surface 258. Rear surface 258 is co-extensive and coplanar with an inner-facing upper surface 260 of first housing portion 110, from which extend protrusions 153 (FIG. 2B) which define axis 152 (FIG. 2A). Rear wall 255 of enclosure 240 forms part of an upper wall portion 262 of first housing portion 110, in which a number of cut-outs, which are suitable for attachment thereto of straps or other elements (not shown) for optionally fixing the device 100 onto a vehicle, are preferably defined.

Figure 5A:
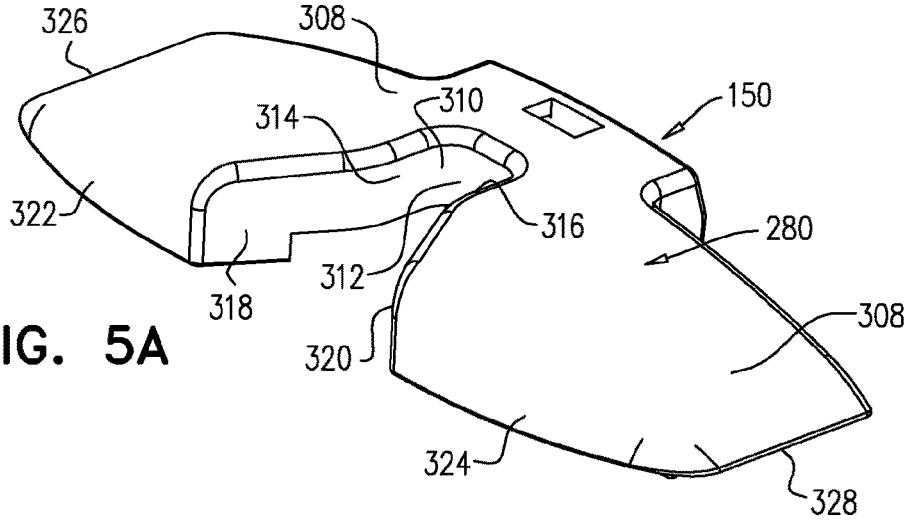
FIGS. 5A, 5B and 5C are simplified respective top view, back view and front view pictorial illustrations of a cover member, forming part of the vehicle-mountable child protective device of FIGS. 1A-2B.
Figure 5B:
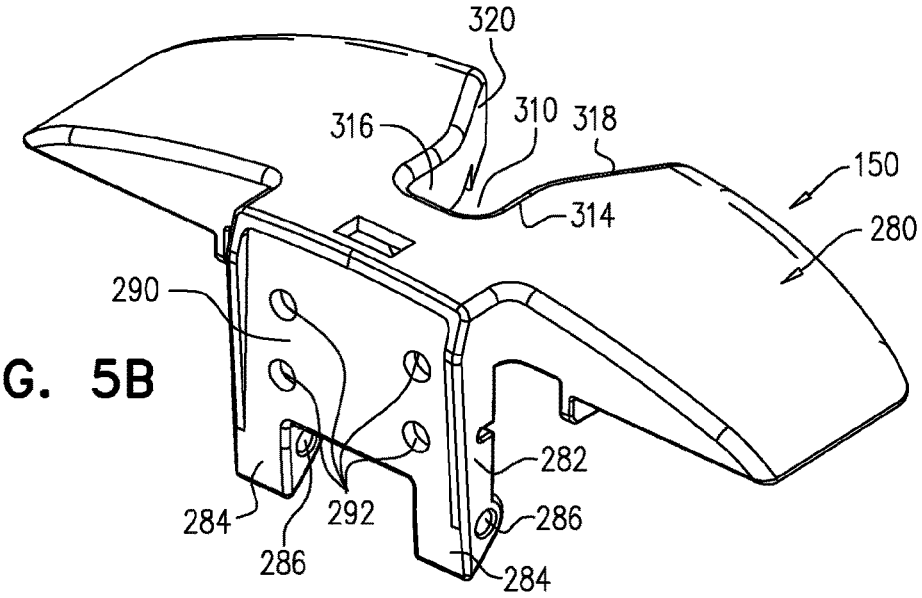
Figure 5C:
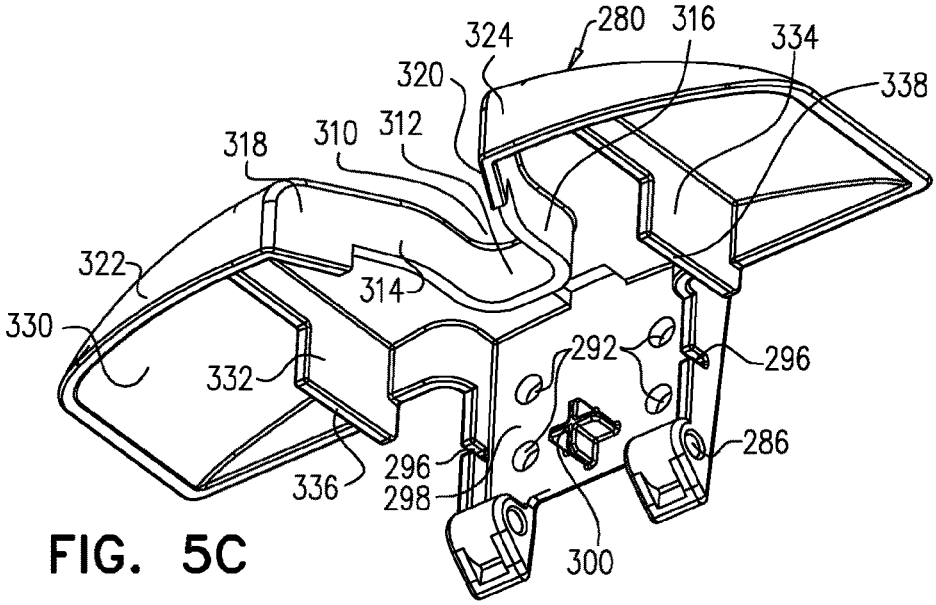
Figure 6A:
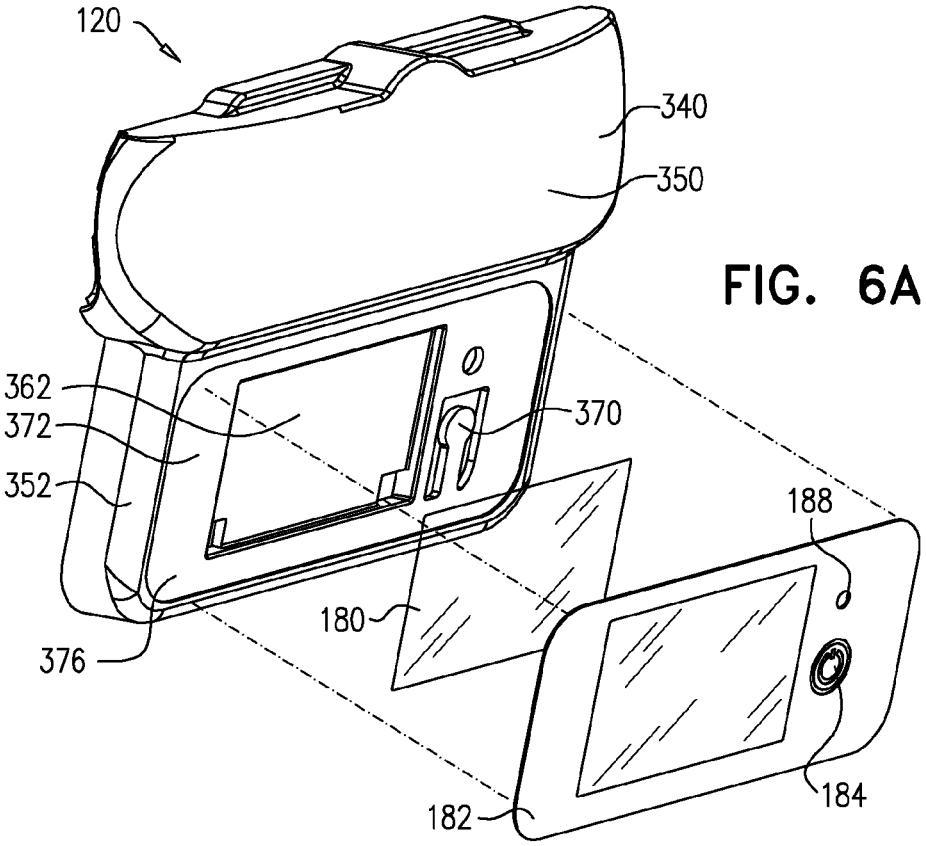
FIGS. 6A and 6B are simplified pictorial illustrations, taken in mutually opposite directions, of a vehicle exterior-facing housing portion assembly of the vehicle-mountable child protective device of FIGS. 1A-2B, FIG. 6A being partially exploded.
Figure 6B:
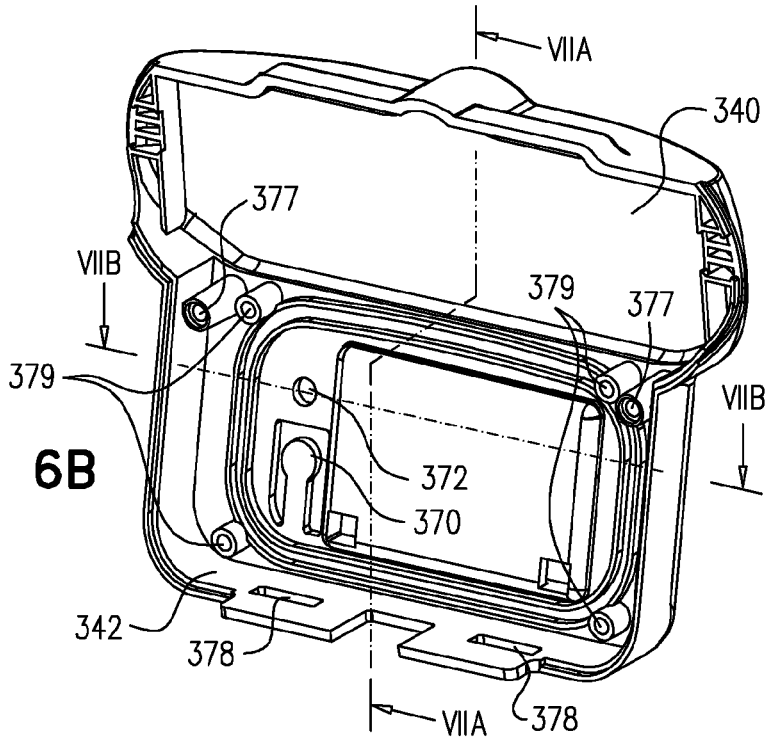
Figure 7A:
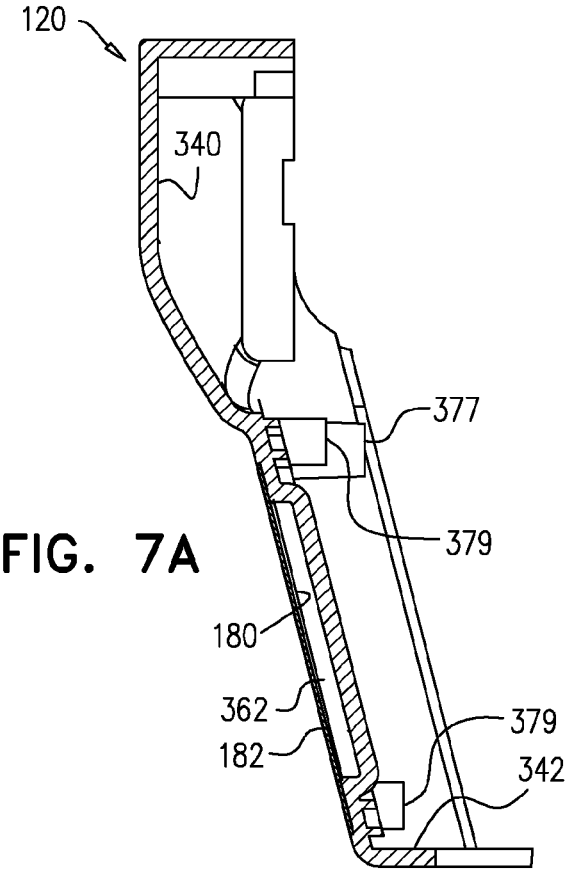
FIGS. 7A and 7B are simplified respective first and second sectional illustrations of the vehicle exterior-facing housing portion of FIGS. 6A and 6B, taken along respective lines VA-VIIA and VIIB-VIIB in FIG. 6B.
Figure 7B:
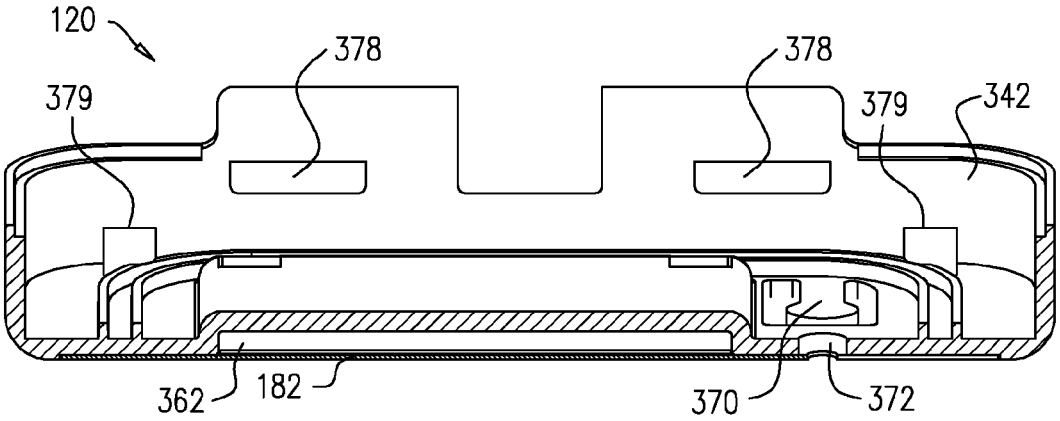

Reference is now made to FIGS. 5A, 5B and 5C, which are simplified respective top view, back view and front view pictorial illustrations of cover member 150, forming part of the vehicle-mountable child protective device of FIGS. 1A-2B.

As seen in FIGS. 5A-5C, cover member 150 includes a generally planar flagpole engagement portion 280, which is preferably integrally formed with a depending portion 282 which includes a pair of apertured downwardly-extending protrusions 284, whose apertures 286 are mutually axially aligned along axis 152 (FIGS. 2A & 2B) and receive axle 154 (FIGS. 2A & 2B). A rear surface 290 of depending portion 282 defines a plurality of apertures 292 for receiving corresponding protrusions 159 of vehicle engagement pad 158.

Depending portion 282 also preferably includes a pair of spring engagement notches 296, each for receiving an end of one of springs 156 (FIGS. 2A & 2B). A forward facing surface 298 of depending portion 282 defines a pin engagement protrusion 300 for engagement with cover member engagement end 164 of pin 160.

Generally planar flagpole engagement portion 280 preferably defines a curved top surface 308 which includes an upright flagpole retaining slot 310, preferably having a rearwardmost end wall 312 and parallel side walls 314 and 316. A pair of flared side walls 318 and 320 extend forwardly (in the sense of FIG. 5A) of parallel side walls 314 and 316 to respective forward edge walls 322 and 324 and onwardly to respective side edge walls 326 and 328.

Formed on an underside surface 330 of generally planar flagpole engagement portion 280 are a pair of lowered flagpole engaging protrusions designated by reference numerals 332 and 334, having respective flagpole engagement edges 336 and 338.

Reference is now made to FIGS. 6A-7B, which are simplified pictorial illustrations, taken in mutually opposite directions, of a vehicle exterior-facing housing portion assembly forming part of the vehicle-mountable child protective device of FIGS. 1A-2B and including second housing portion 120, solar energy generating array 180 and environmentally protected face plate 182 (FIGS. 2A & 2B).

As seen in FIGS. 6A-7B, the second housing portion 120 includes an upper wall portion 340 and a lower wall portion 342. Upper wall portion 340 defines a generally planar outwardly-facing upper surface 350 and lower wall portion 342 defines a generally planar outwardly-facing lower surface 352.

Lower wall portion 342 defines a mounting recess 362 for receiving and retaining solar energy generating array 180 therein. Lower wall portion 342 also includes a cut, which defines a resilient push button tab 370, which is displaceable inwardly in the sense of FIG. 6A, by a user pushing on flexible portion 184 of environmentally protected face plate 182 thereby activating push button 176 mounted on PCB 172 (FIGS. 2A & 2B). Lower wall portion 342 also defines a sound transmission aperture 372, which is preferably aligned with aperture 188 of environmentally protected face plate 182.

Lower wall portion 342 additionally defines a forward-facing recess 376 for receiving environmentally protected face plate 182. Lower wall portion 342 also is preferably integrally formed with two assembly bosses 377 which serve for assembly of second housing portion 120 in engagement with first housing portion 110 by means of screws (not shown). Lower wall portion 342 also is preferably integrally formed with two assembly clip receiving elongate apertures 378 for receiving assembly clips 219 of first housing portion 110 for locking of second housing portion 120 and first housing portion 110.

Lower wall portion 342 also is preferably integrally formed with four assembly bosses 379 which serve for assembly of second housing portion 120 in engagement with electronics enclosure element 170 by means of screws (not shown).

Figure 8A:
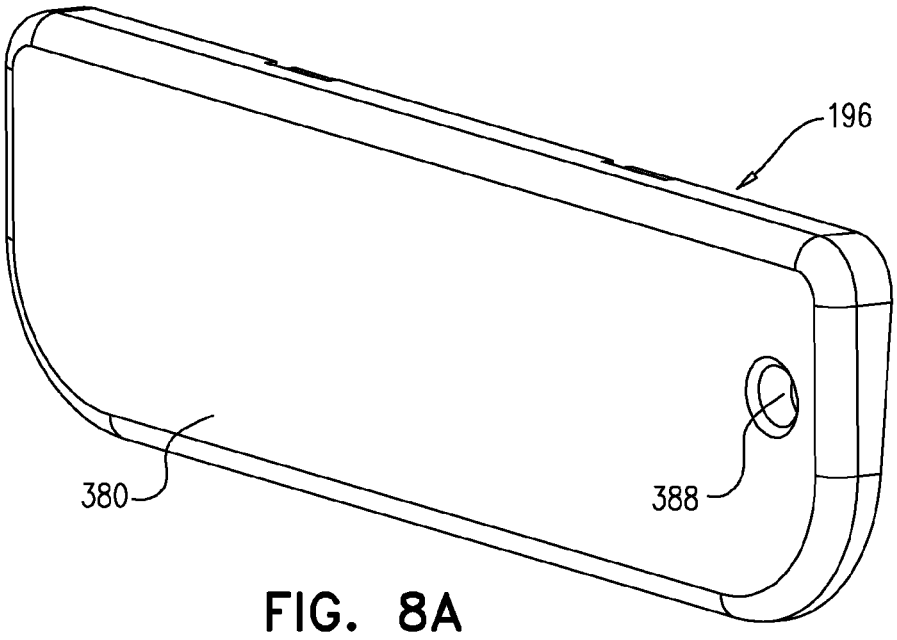
FIGS. 8A and 8B are simplified pictorial illustrations, taken in mutually opposite directions, of a vehicle interior-facing panel, forming part of the vehicle-mountable child protective device of FIGS. 1A-2B.
Figure 8B:
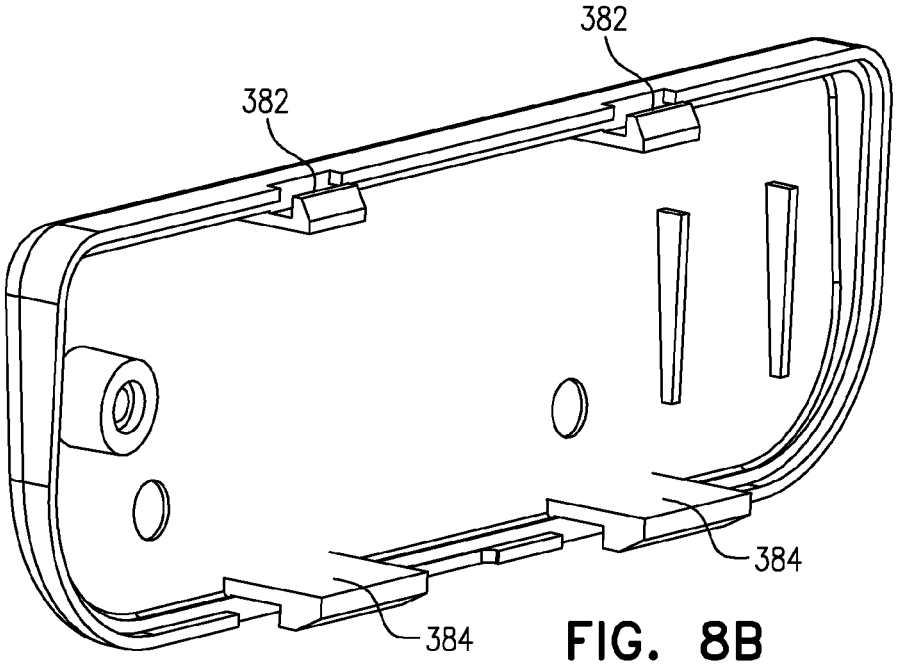

Reference is now made to FIGS. 8A and 8B, which are simplified pictorial illustrations, taken in mutually opposite directions, of vehicle interior-facing panel 196, forming part of the vehicle-mountable child protective device of FIGS. 1A-2B. As seen in FIGS. 8A and 8B, panel 196 is formed with a generally planar interior-facing surface 380 and a pair of top attachment clips 382 and a pair of bottom attachment clips 384 for removable attachment to first housing portion 110 over PCB 192 and battery 190. Panel 196 is preferably formed with at least one aperture 388 for providing communication with the ambient inside the vehicle, as for temperature sensing, audio sensing or sensing of any other appropriate parameter. Aperture 388 may also permit escape of heat from the PCB.

Figure 9A:
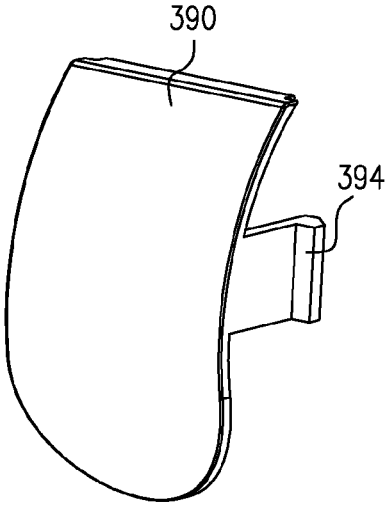
FIGS. 9A and 9B are simplified pictorial illustrations, taken in mutually opposite directions, of a side-facing panel, forming part of the vehicle-mountable child protective device of FIGS. 1A-2B.
Figure 9B:
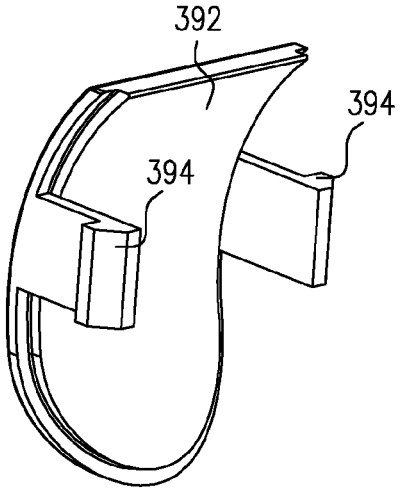

Reference is now made to FIGS. 9A and 9B, which are simplified pictorial illustrations, taken in mutually opposite directions, of side-facing panel 146, forming part of the vehicle-mountable child protective device of FIGS. 1A-2B. As seen in FIGS. 9A & 9B, side-facing panel 146 preferably is formed with curved respective outer and inner surfaces 390 and 392 and a pair of side attachment clips 394 for attachment to first and second housing portions 110 and 120, respectively.

Figure 10A:
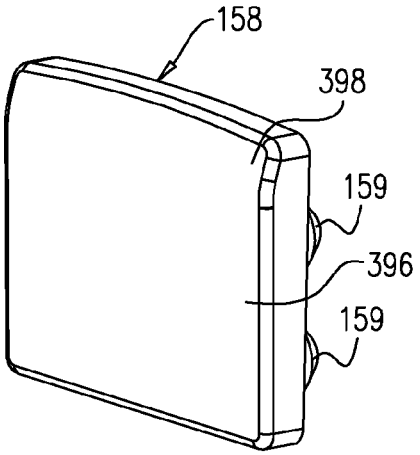
FIGS. 10A and 10B are simplified pictorial illustrations, taken in mutually opposite directions, of a vehicle engagement pad, forming part of the vehicle-mountable child protective device of FIGS. 1A-2B.
Figure 10B:
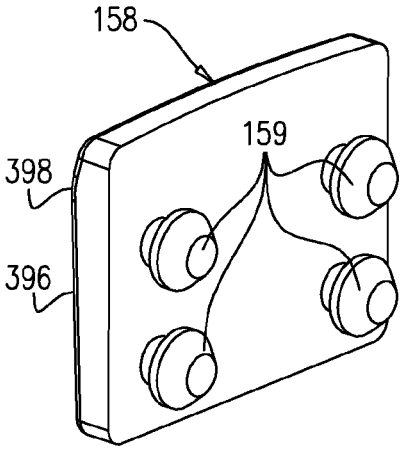
Figure 11A:
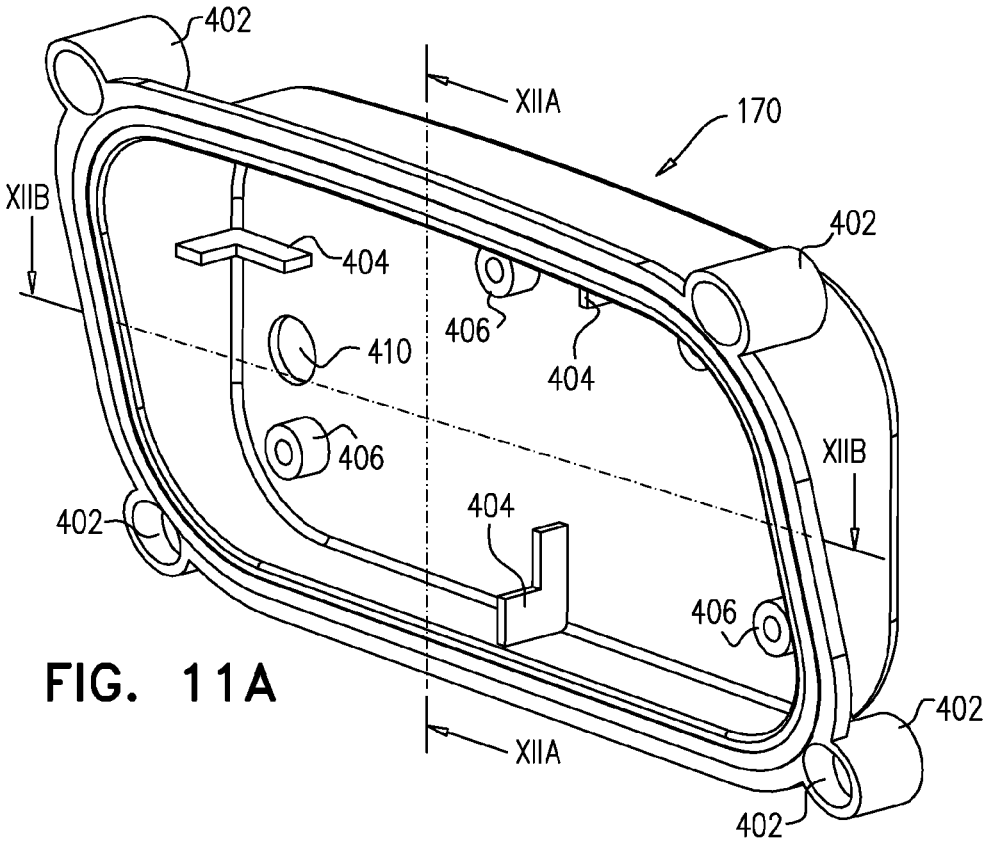
FIGS. 11A and 11B are simplified pictorial illustrations, taken in mutually opposite directions, of a chassis element, forming part of the vehicle-mountable child protective device of FIGS. 1A-2B.
Figure 11B:
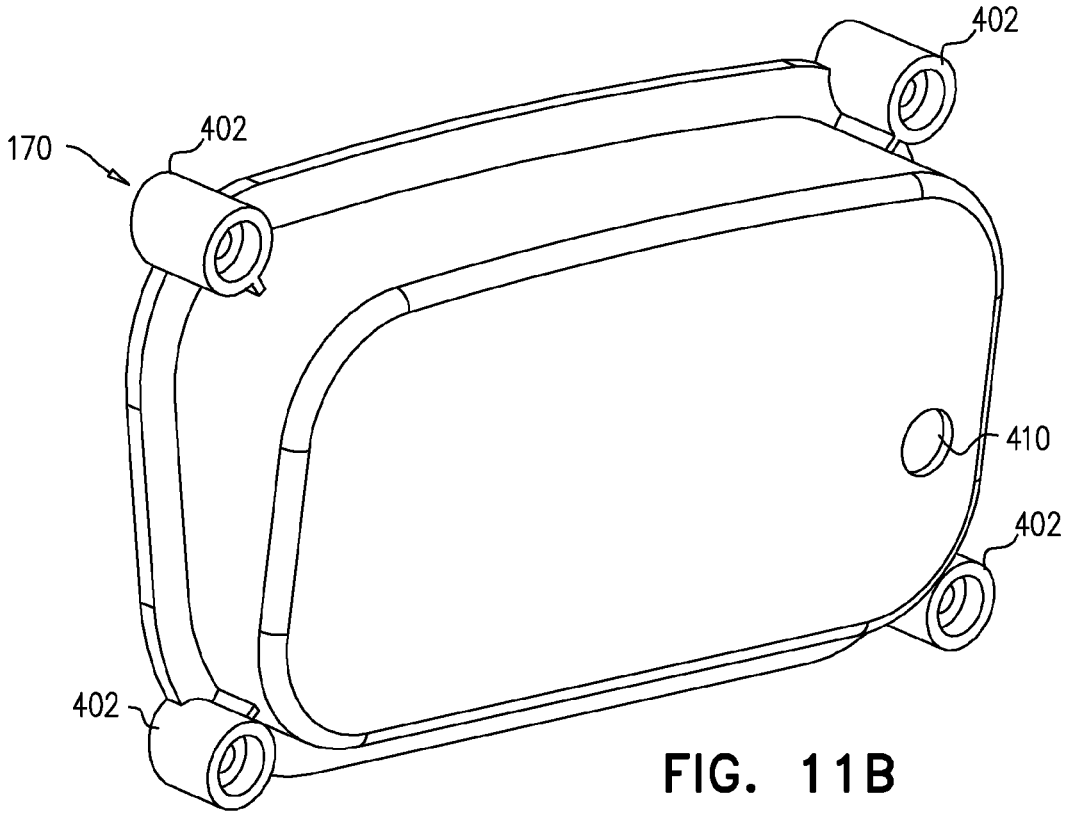
Figure 12A:
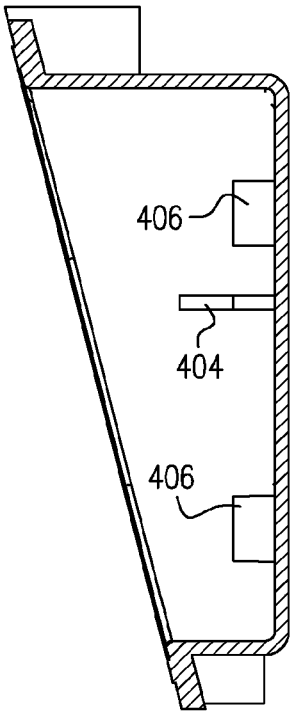
FIGS. 12A and 12B are simplified respective first and second sectional illustrations of the chassis element of FIGS. 11A and 11B, taken along respective lines XIIA-XIIA and XIIB-XIIB in FIG. 11A.
Figure 12B:
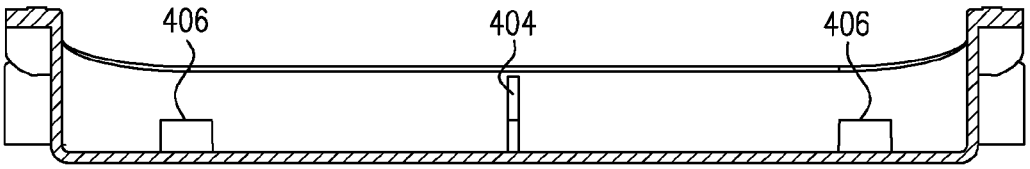

Reference is now made to FIGS. 10A and 10B, which are simplified pictorial illustrations, taken in mutually opposite directions, of vehicle engagement pad 158, which, as noted above with reference to FIGS. 2A & 2B, includes forward-facing snap-fit locating protrusions 159. It is seen that vehicle engagement pad 158 preferably includes a generally planar vehicle engagement surface 396, having a slightly angled upper surface portion 398.

Reference is now made to FIGS. 11A-12B, which are simplified pictorial illustrations of electronics enclosure element 170, forming part of the vehicle-mountable child protective device of FIGS. 1A-2B. As seen in FIGS. 11A-12B, electronics enclosure element 170 preferably includes a plurality of assembly bosses 402, which serve for assembly of electronics enclosure element 170 in engagement with second housing portion 120 by means of screws (not shown), prior to assembly of first housing portion and second housing portion 120 described hereinabove with reference to FIGS. 6A-7B.

Electronics enclosure element 170 defines an enclosure for PCB 172 (FIGS. 2A & 2B) and preferably includes PCB mounting protrusions 404 and mounting bosses 406 at an interior thereof. Electronics enclosure element 170 also preferably includes an aperture 410 for passage therethrough of electrical wiring (not shown).

Figures 13A, 13B:
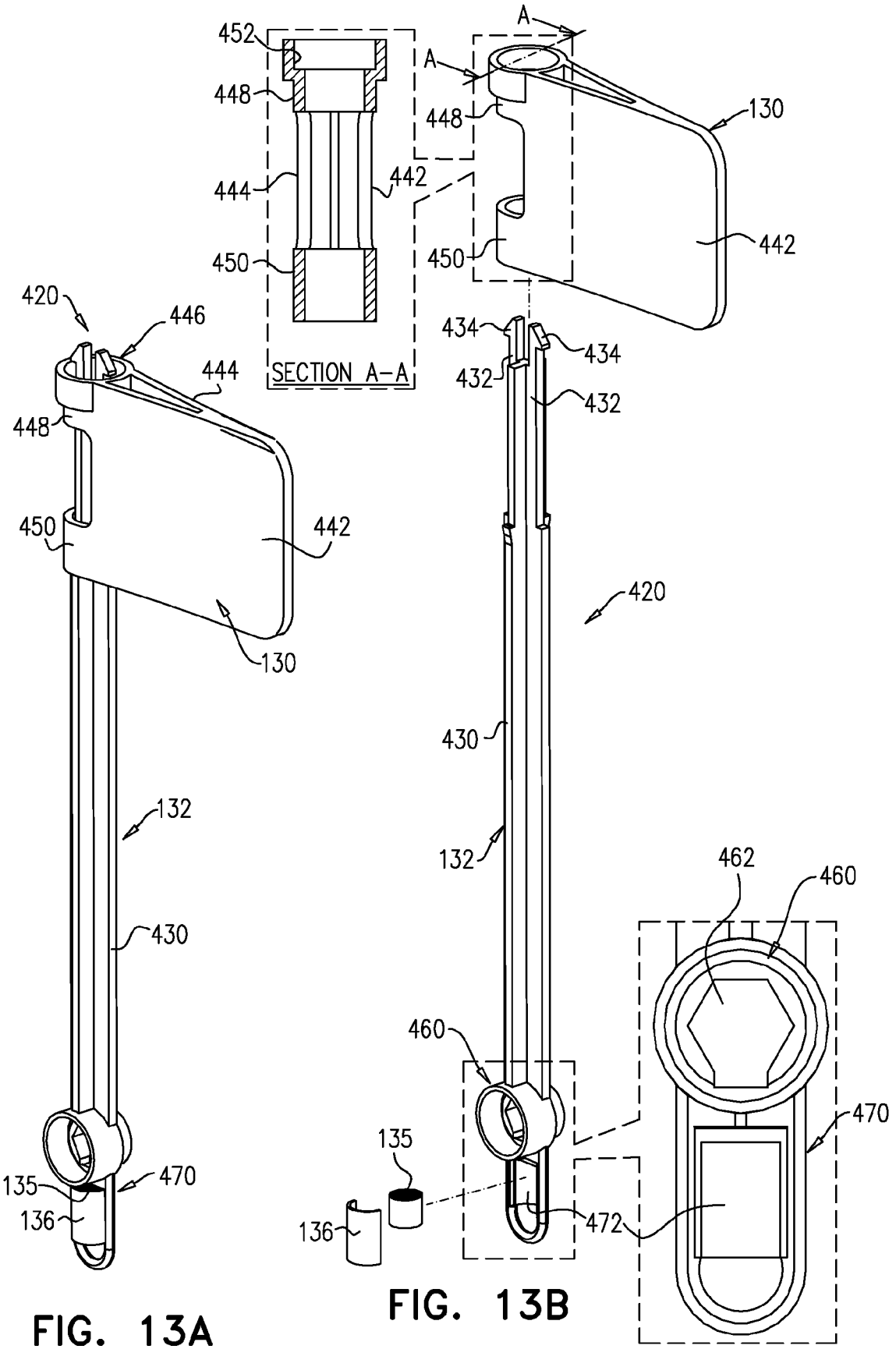
FIGS. 13A and 13B are simplified respective assembled and exploded view pictorial illustrations of a rotatable flag assembly, forming part of the vehicle-mountable child protective device of FIGS. 1A-2B.
Figure 14A:
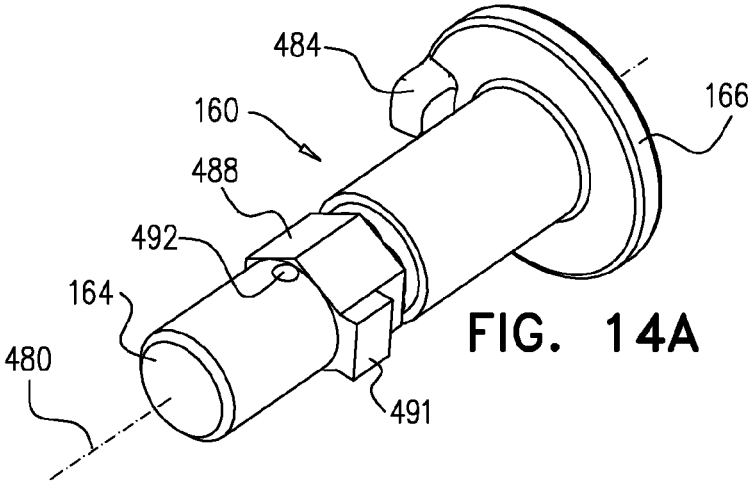
FIGS. 14A, 14B, 14C and 14D are simplified respective pictorial, pictorial and sectional, planar view, end view and sectional view illustrations of a retaining pin forming part of the vehicle-mountable child protective device of FIGS. 1A-2B, FIG. 14D being taken along lines XIVD-XIVD in FIG. 14C.
Figure 14B:
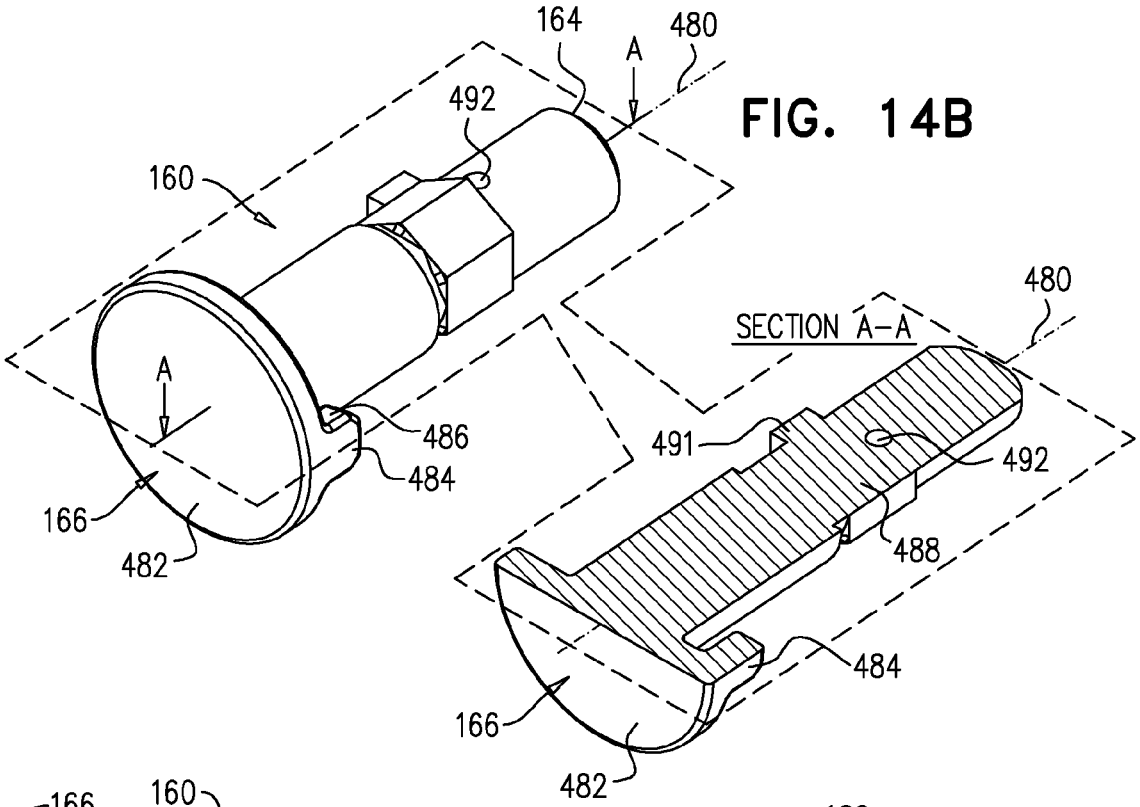
Figure 14C:
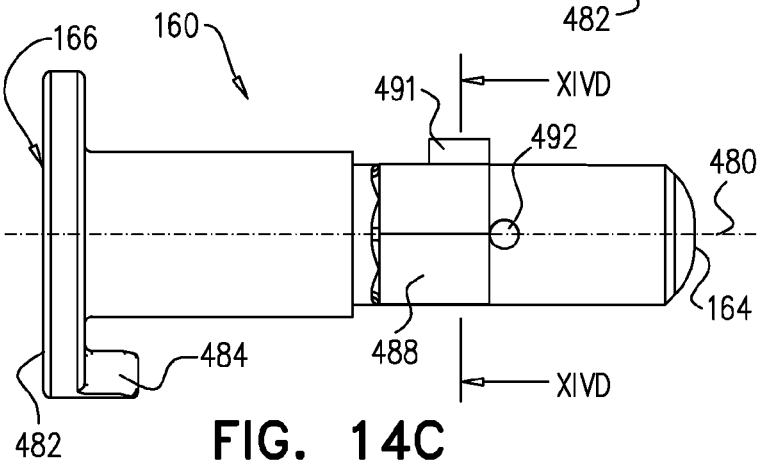
Figure 14D:
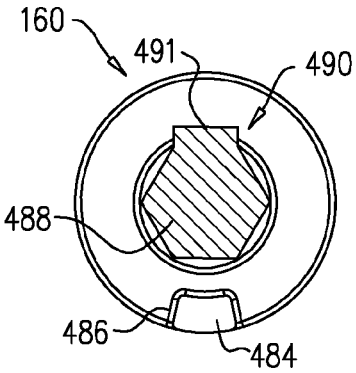
Figure 15A:
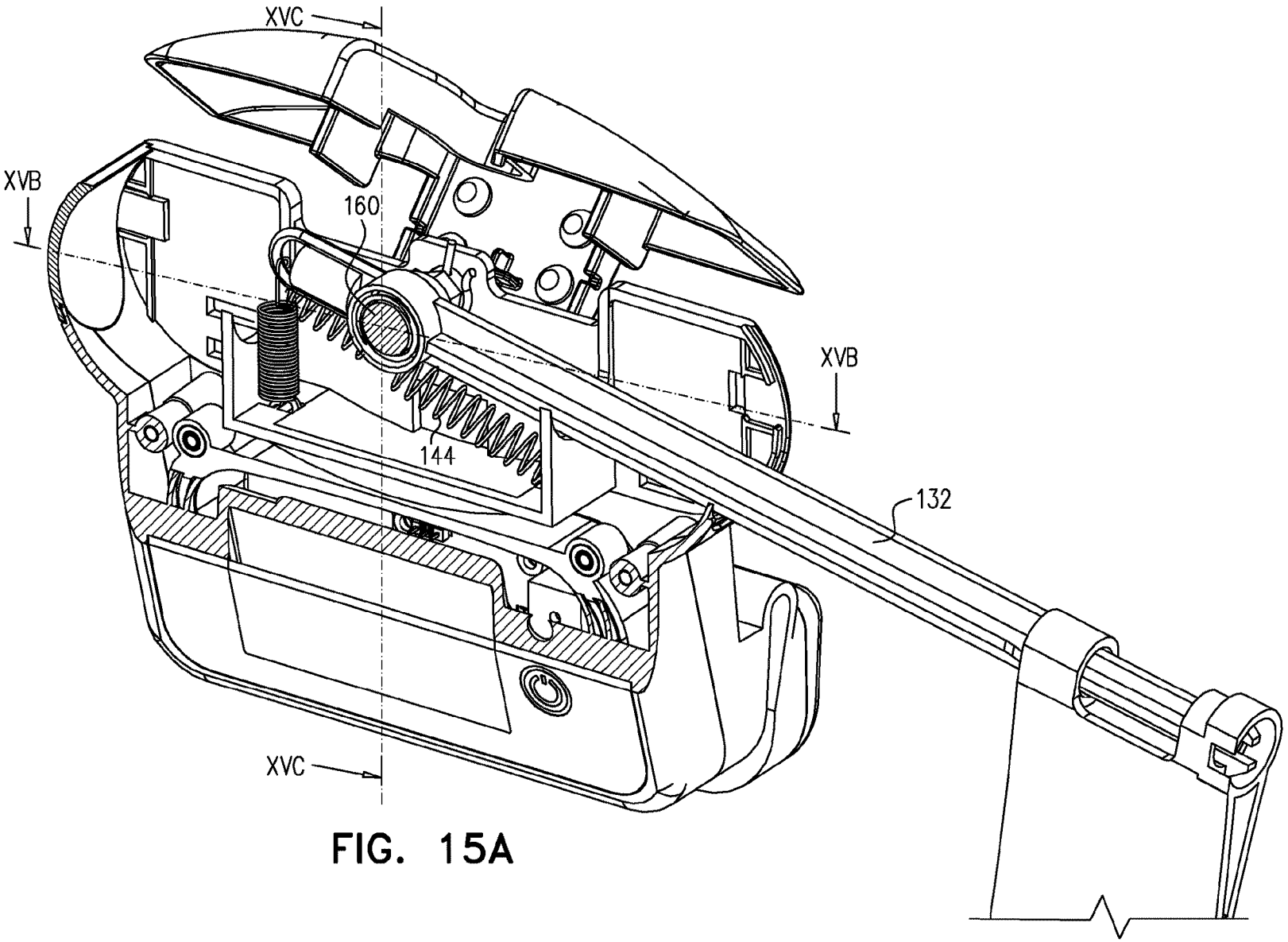
FIGS. 15A, 15B, 15C and 15D are simplified respective partially cut-away pictorial and first, second and third sectional illustrations of the vehicle-mountable child protective device of FIGS. 1A-2B in a first operative orientation, FIGS. 15B and 15C being taken along respective lines XVB-XVB and XVC-XVC in FIG. 15A and FIG. 15D being taken along respective lines XVD-XVD in FIG. 15C.
Figure 15B:
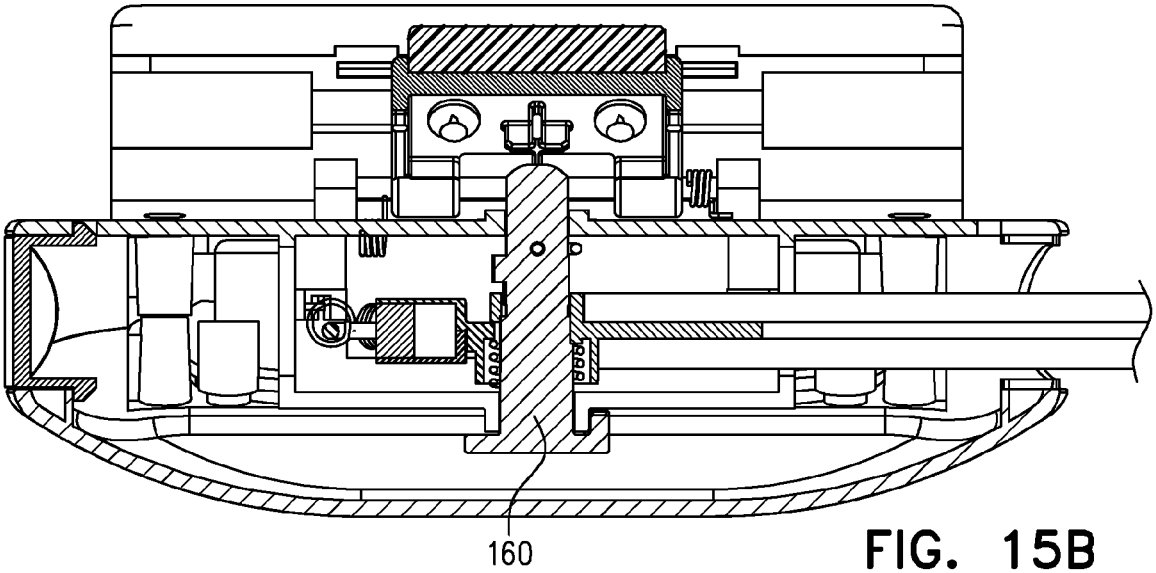
Figure 15C:
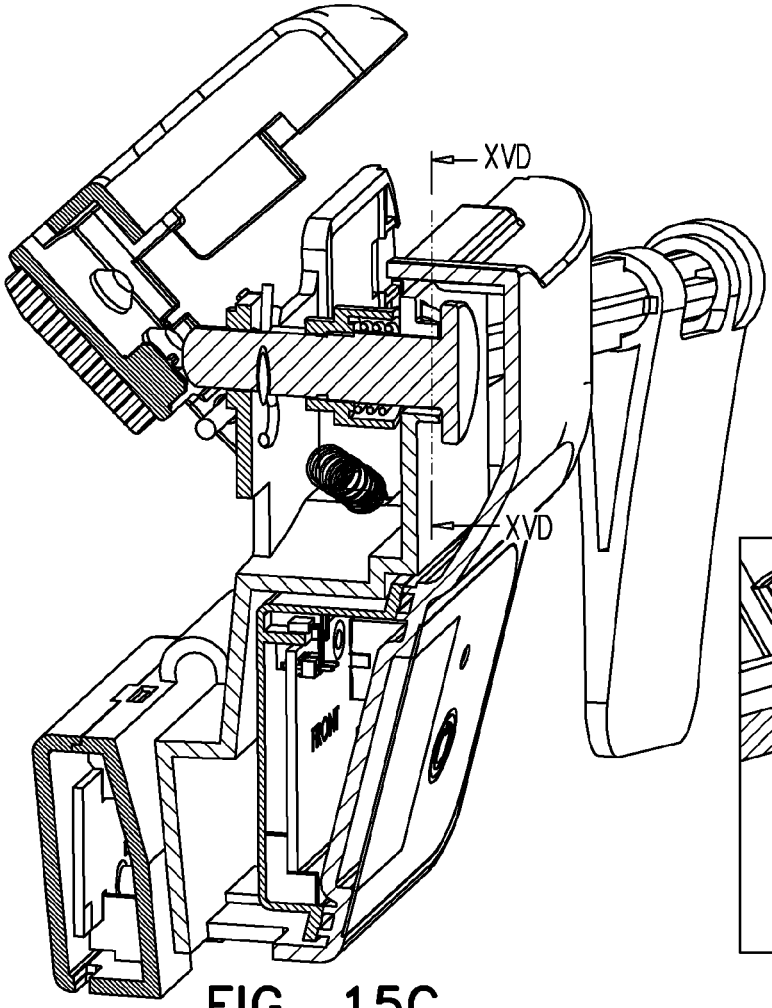
Figure 15D:
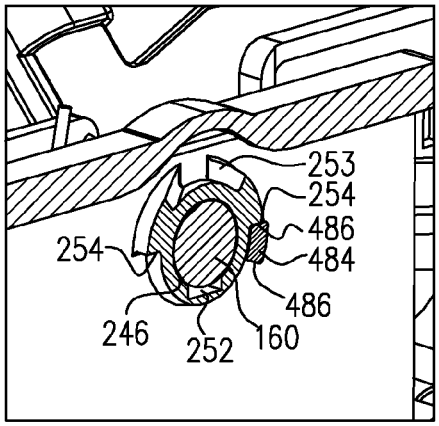

Reference is now made to FIGS. 13A and 13B, which are simplified respective assembled and exploded view pictorial illustrations of a rotatable flag assembly 420, forming part of the vehicle-mountable child protective device of FIGS. 1A 2B. Rotatable flag assembly 420 preferably comprises flag 130, flagpole 132 and magnet 135 (FIGS. 2A & 2B).

As seen in FIGS. 13A & 13B, flagpole 132 preferably includes a main shaft portion 430 having a generally cruciform cross-section and formed, at a top thereof, with a pair of spring clips 432 having respective retaining teeth 434 for rotatably retaining flag 130 thereon. Flag 130 is preferably formed as a unitary element having a pair of generally flat surfaces 442 and 444, which are typically angled with respect to each other and extend from a flagpole engagement portion 446 thereof, which includes upper and lower flagpole retaining rings 448 and 450. Upper retaining ring 448 is preferably configured to define an annular shoulder surface 452 which is retainably engaged by teeth 434.

Flagpole 132 is preferably formed below main shaft portion 430 thereof with a mounting sprocket 460 having a notched hexagonal cutout 462 formed therein for receiving pin 160 therein in non-mutually rotatable engagement therewith. Flagpole 132 is also preferably formed below mounting sprocket 460 with a magnet mount portion 470 defining a magnet mounting recess 472 for retaining magnet 135 therein.

Reference is now made to FIGS. 14A-14D, which illustrate retaining pin 160. As seen in FIGS. 14A-14D and noted above, retaining pin 160 is a generally cylindrical pin having a cover member engagement end 164 and a flange 166. Retaining pin 160 preferably is generally circularly symmetric about a pin axis 480, other than as described hereinbelow.

Flange 166 includes a forward-facing surface 482 (in the sense of FIG. 2A), which lies in a plane perpendicular to pin axis 480 and which includes, at an edge thereof, a cam riding protrusion 484 which extends rearwardly of surface 482 and engages one of a pair of mutually spaced oppositely directed circumferentially extending inclined cam surfaces 253 (FIGS. 3A-4B). Cam riding protrusion 484 includes a locking surface 486 preferably on each side thereof.

At an intermediate location along the length thereof rearward of flange 166, retaining pin 160 is formed with an engagement section 488, having a generally hexagonal cross section 490 including a protruding portion 491, which is configured and sized for non-mutually rotatable engagement with notched hexagonal cutout 462 of mounting sprocket 460 of flagpole 132 (FIG. 13B). Rearward of engagement section 488, retaining pin 160 is preferably formed with a transverse bore 492 for receiving retaining spring clip 162 (FIGS. 2A & 2B), which limits the position of the flagpole 132 along pin axis 480.

Reference is now made to FIGS. 15A, 15B, 15C and 15D, which are simplified respective partially cut-away pictorial and first, second and third sectional illustrations of the vehicle-mountable child protective device of FIGS. 1A-2B in a first operative orientation. As seen in FIGS. 15A-15D, flagpole 132 is in a lowered operative orientation against the urging of flag positioning spring 144, which is tensioned.

Flagpole 132 is retained in the lowered operative orientation by engagement of locking surface 486 of cam riding protrusion 484 of pin 160 with a radially-extending locking engagement surface 254 of circumferentially extending inclined cam surface 253.

Reference is now made to FIGS. 16A, 16B, 16C and 16D, which are simplified respective partially cut-away pictorial and first, second and third sectional illustrations of the vehicle-mountable child protective device of FIGS. 1A-2B in a second operative orientation. As seen in FIGS. 16A-16D, flagpole 132 is in a lowered operative orientation against the urging of flag positioning spring 144, which is tensioned.

As distinguished from the operative orientation of FIGS. 15A-15D, flagpole 132 is not retained in a lowered operative orientation by engagement of locking surface 486 of cam riding protrusion 484 of pin 160 with a radially-extending locking engagement surface 254 of circumferentially extending inclined cam surface 253. Rather, flagpole 132 is retained in a lowered operative orientation by engagement of one of flagpole engagement edges 336 and 338 of respective lowered flagpole engaging protrusions 332 and 334 of cover member 150 with main shaft portion 430 thereof, when cover member 150 is maintained in the closed lowered operative orientation. As will be described hereinbelow with reference to FIGS. 21A-21I, cover member 150 is maintained in the closed lowered operative orientation, when manually held by a user or when mounted on a closed window of a vehicle door when the door is closed.

Figure 16A:
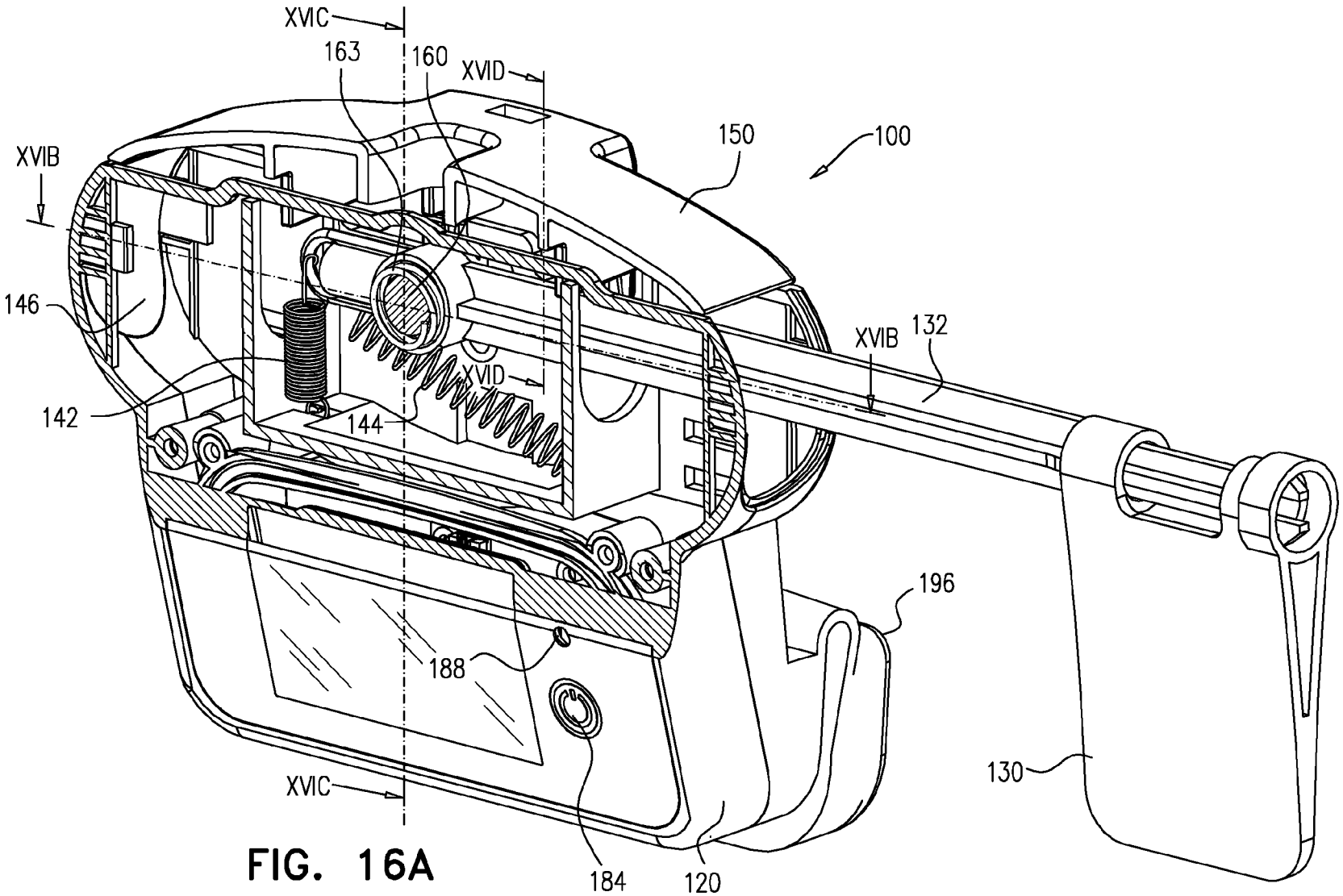
FIGS. 16A, 16B, 16C and 16D are simplified respective partially cut-away pictorial and first, second and third sectional illustrations of the vehicle-mountable child protective device of FIGS. 1A-2B in a second operative orientation, FIGS. 16B, 16C and 16D being taken along respective lines XVIB-XVIB, XVIC-XVIC and XVID-XVID in FIG. 16A.
Figure 16B:
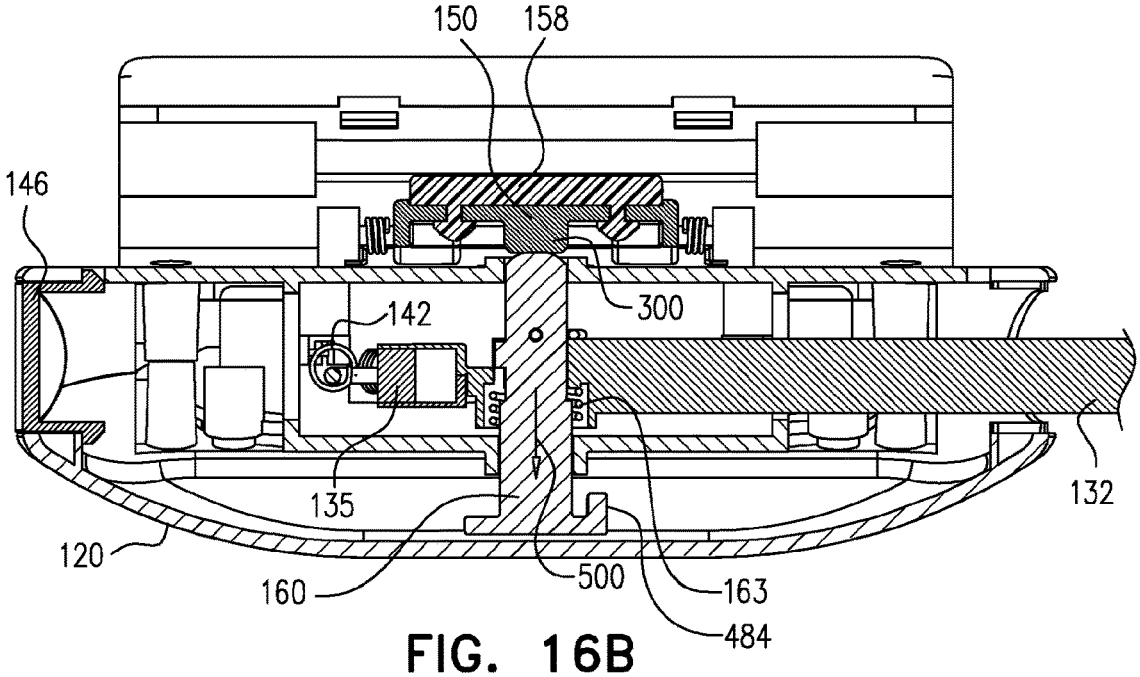
Figure 16C:
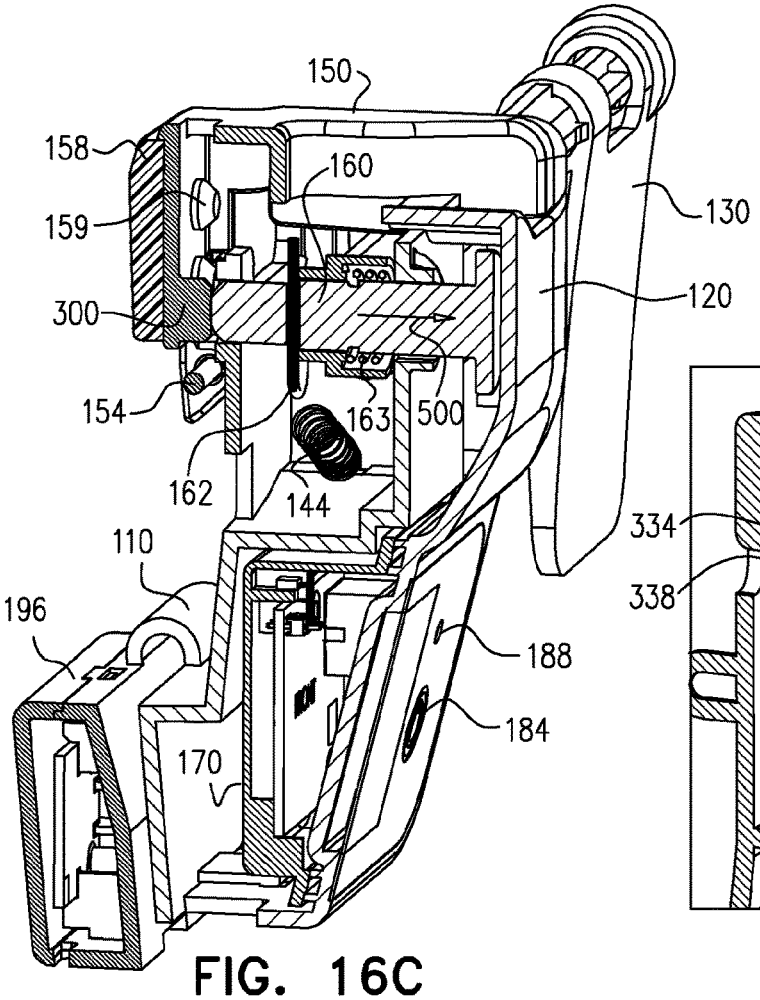
Figure 16D:
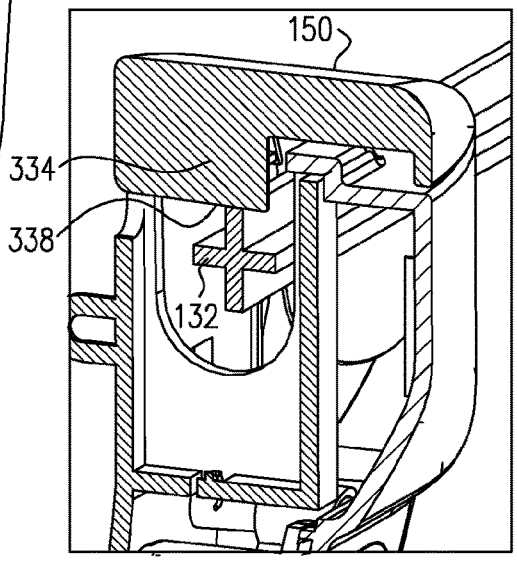

It is noted that, that as seen in FIG. 16B, when cover member 150 is rotated to the closed lowered operative orientation and pin engagement protrusion 300 thereof (FIG. 5C) is in engagement with cover member engagement end 164 of pin 160, pin 160 is linearly displaced, against the urging of retaining pin coil spring 163 and as indicated by an arrow 500, axially along pin axis 480 to a position wherein cam riding protrusion 484 of pin 160 is disengaged from circumferentially extending inclined cam surface 253.

Reference is now made to FIGS. 17A, 17B, 17C and 17D, which are simplified respective partially cut-away pictorial and first, second and third sectional illustrations of the vehicle-mountable child protective device of FIGS. 1A-2B in a third operative orientation. As seen in FIGS. 17A-17D, flagpole 132 is rotated in a raised operative orientation as urged by flag positioning spring 144.

As distinguished from the operative orientation of FIGS. 16A-16D, flagpole 132 is no longer retained in a lowered operative orientation by engagement of one of flagpole engagement edges 336 and 338 of respective lowered flagpole engaging protrusions 332 and 334 of cover member 150 with main shaft portion 430 thereof when cover member 150 is rotated to the open raised operative orientation. As will be described hereinbelow with reference to FIGS. 21A-21I, cover member 150 is enabled to assume the open raised operative orientation, when mounted on a closed window of a vehicle door and the door is opened.

Figure 17A:
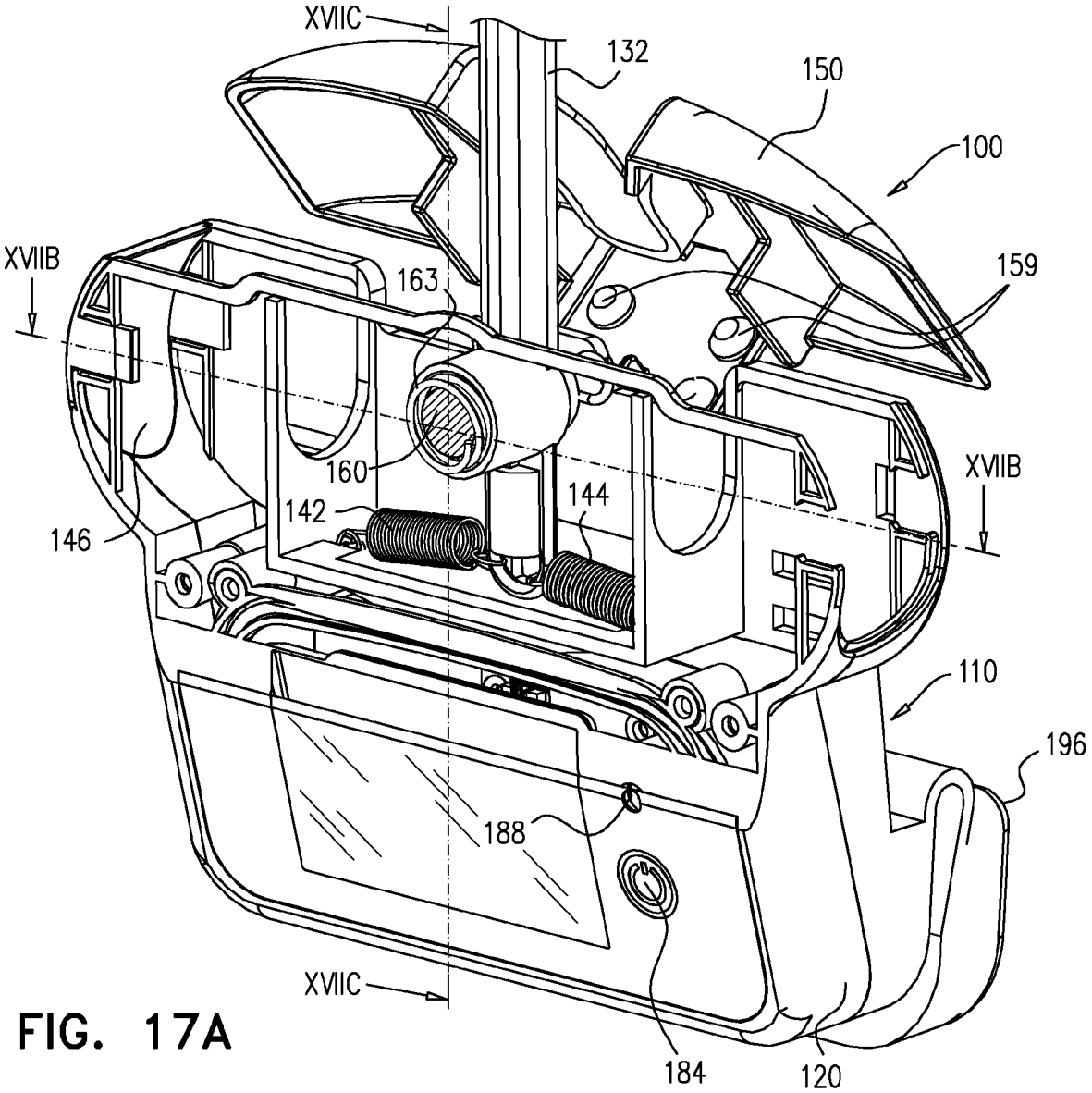
FIGS. 17A, 17B, 17C and 17D are simplified respective partially cut-away pictorial and first, second and third sectional illustrations of the vehicle-mountable child protective device of FIGS. 1A-2B in a third operative orientation, FIGS. 17B and 17C being taken along respective lines XVIIB-XVIIB and XVIIC-XVIIC in FIG. 17A and FIG. 17D being taken along respective lines XVIID-XVIID in FIG. 17C.
Figure 17B:
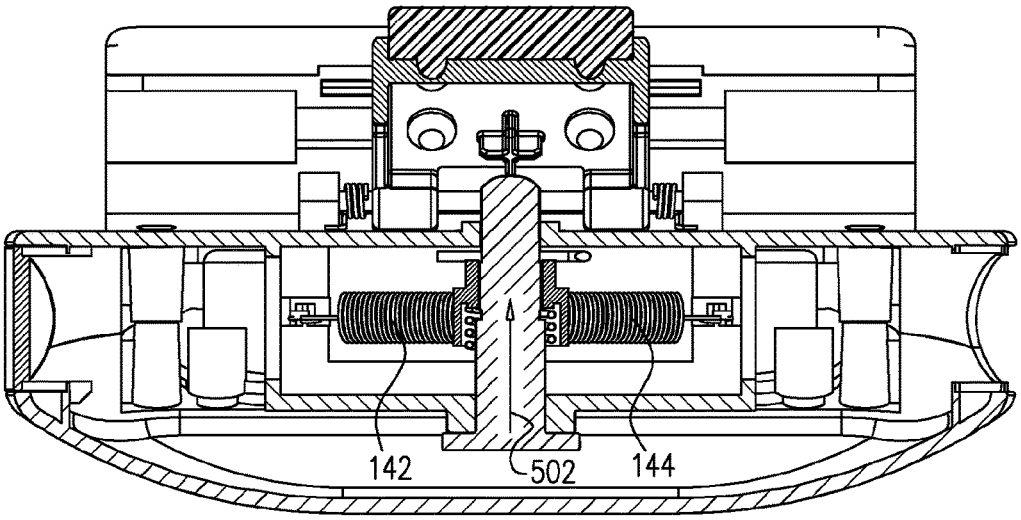
Figure 17C:
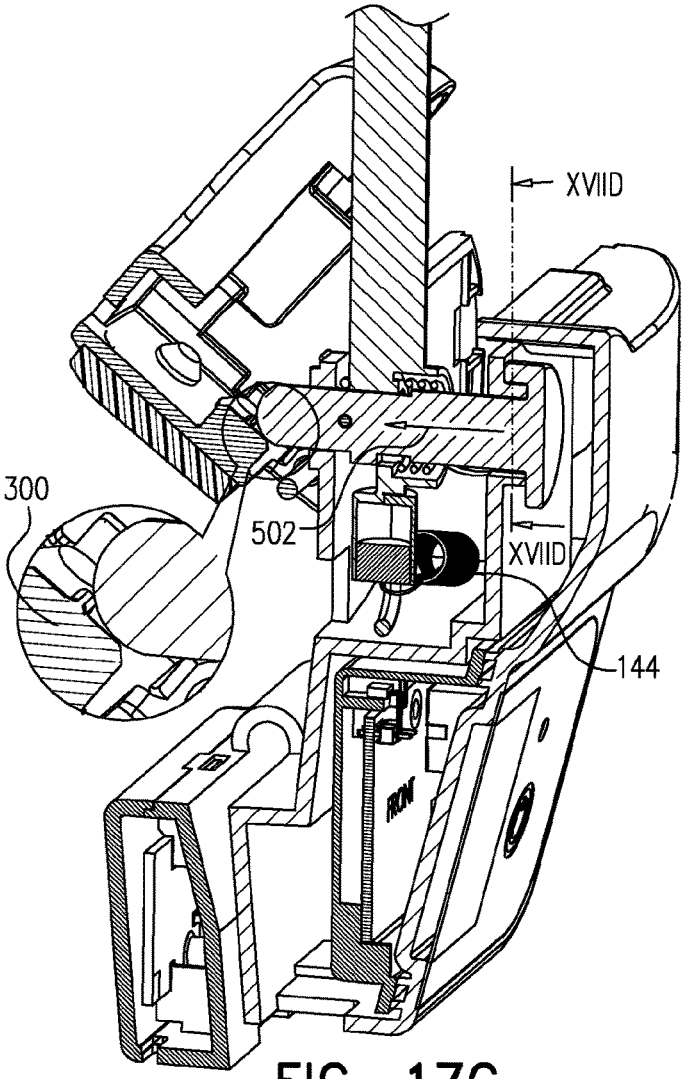
Figure 17D:
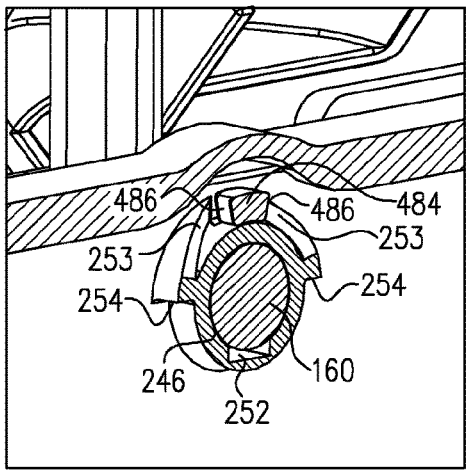

It is noted that, that as seen in FIG. 17B, when cover member 150 is rotated to the open raised operative orientation and pin engagement protrusion 300 thereof (FIG. 5C) is no longer in engagement with cover member engagement end 164 of pin 160, pin 160 is linearly displaced, under the urging of retaining pin coil spring 163 and as indicated by an arrow 502, axially along pin axis 480 to a position wherein cam riding protrusion 484 of pin 160 is located between inclined surfaces of oppositely directed circumferentially extending inclined cam surfaces 253.

Figure 18A:
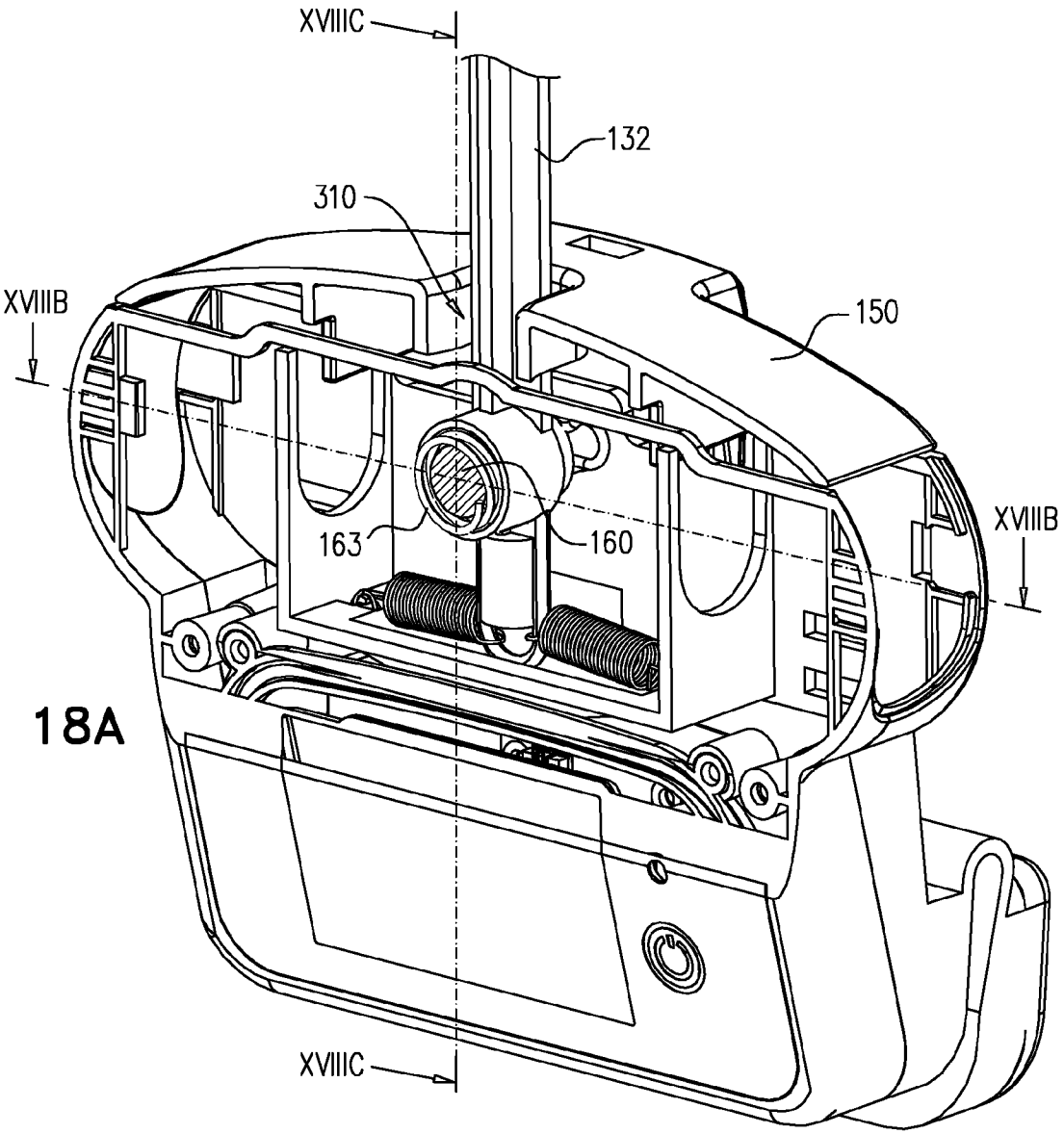
FIGS. 18A, 18B and 18C are simplified respective partially cut-away pictorial and first and second sectional illustrations of the vehicle-mountable child protective device of FIGS. 1A-2B in a fourth operative orientation, FIGS. 18B and 18C being taken along respective lines XVIIIB-XVIIIB and XVIIIC-XVIIIC in FIG. 18A.
Figure 18B:
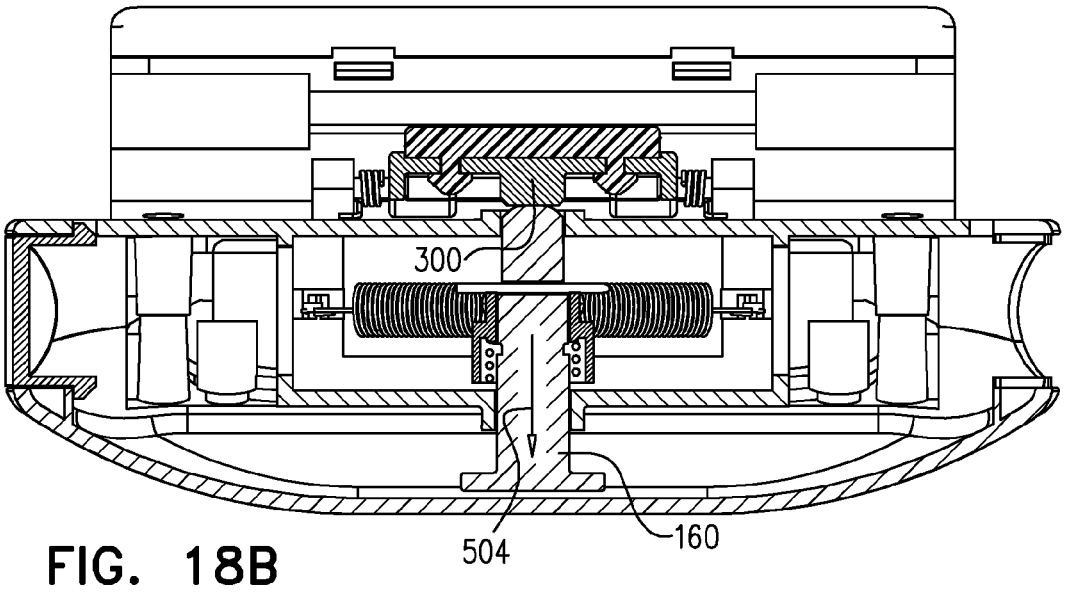
Figure 18C:
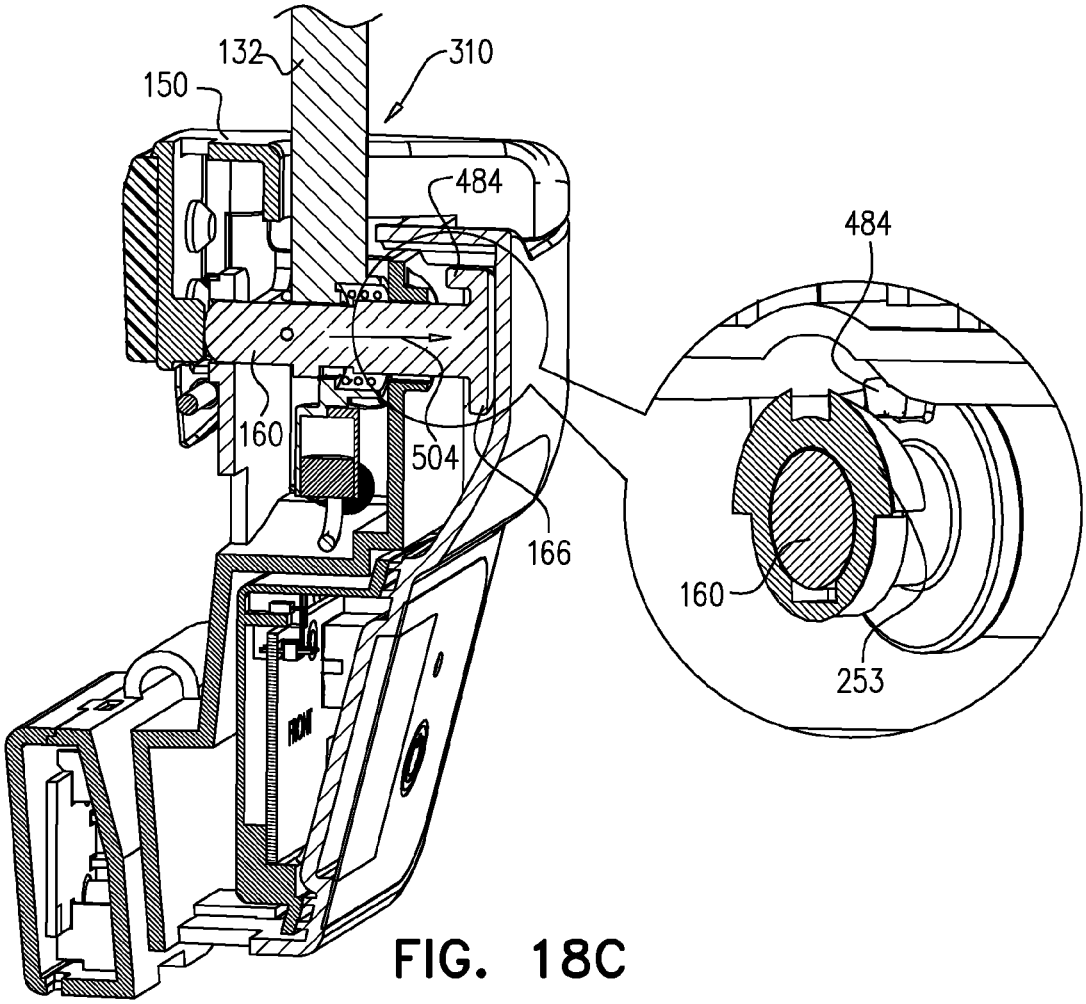

Reference is now made to FIGS. 18A, 18B and 18C, which are simplified respective partially cut-away pictorial and first and second sectional illustrations of the vehicle-mountable child protective device of FIGS. 1A-2B in a fourth operative orientation. As seen in FIGS. 18A-18C, flagpole 132 is retained in a raised operative orientation by rotation of cover member 150 to the closed lowered operative orientation. Pin engagement protrusion 300 thereof (FIG. 5C) is in engagement with cover member engagement end 164 of pin 160 such that upon rotation of cover member 150 to the closed lowered operative orientation, pin 160 is linearly displaced, against the urging of retaining pin coil spring 163 and as indicated by an arrow 504, axially along pin axis 480 to a position wherein cam riding protrusion 484 of pin 160 is disengaged from circumferentially extending inclined cam surfaces 253.

Flagpole 132 is retained in a raised operative orientation by being located in upright flagpole retaining slot 310 of cover member 150 (FIGS. 5A-5C) and, as will be described hereinbelow with reference to FIGS. 21A-21I, cannot be lowered without opening the vehicle door.

Reference is now made to FIGS. 19A, 19B, 19C and 19D, which are simplified respective partially cut-away pictorial and first, second and third sectional illustrations of the vehicle-mountable child protective device of FIGS. 1A-2B in a fifth operative orientation, which is typically identical to the third operative orientation. As seen in FIGS. 19A-19D as compared with FIGS. 18A-18C, the cover member 150 is now in the open raised operative orientation and no longer prevents manual rotation of the flagpole 132 to a lowered operative orientation.

Figure 19A:
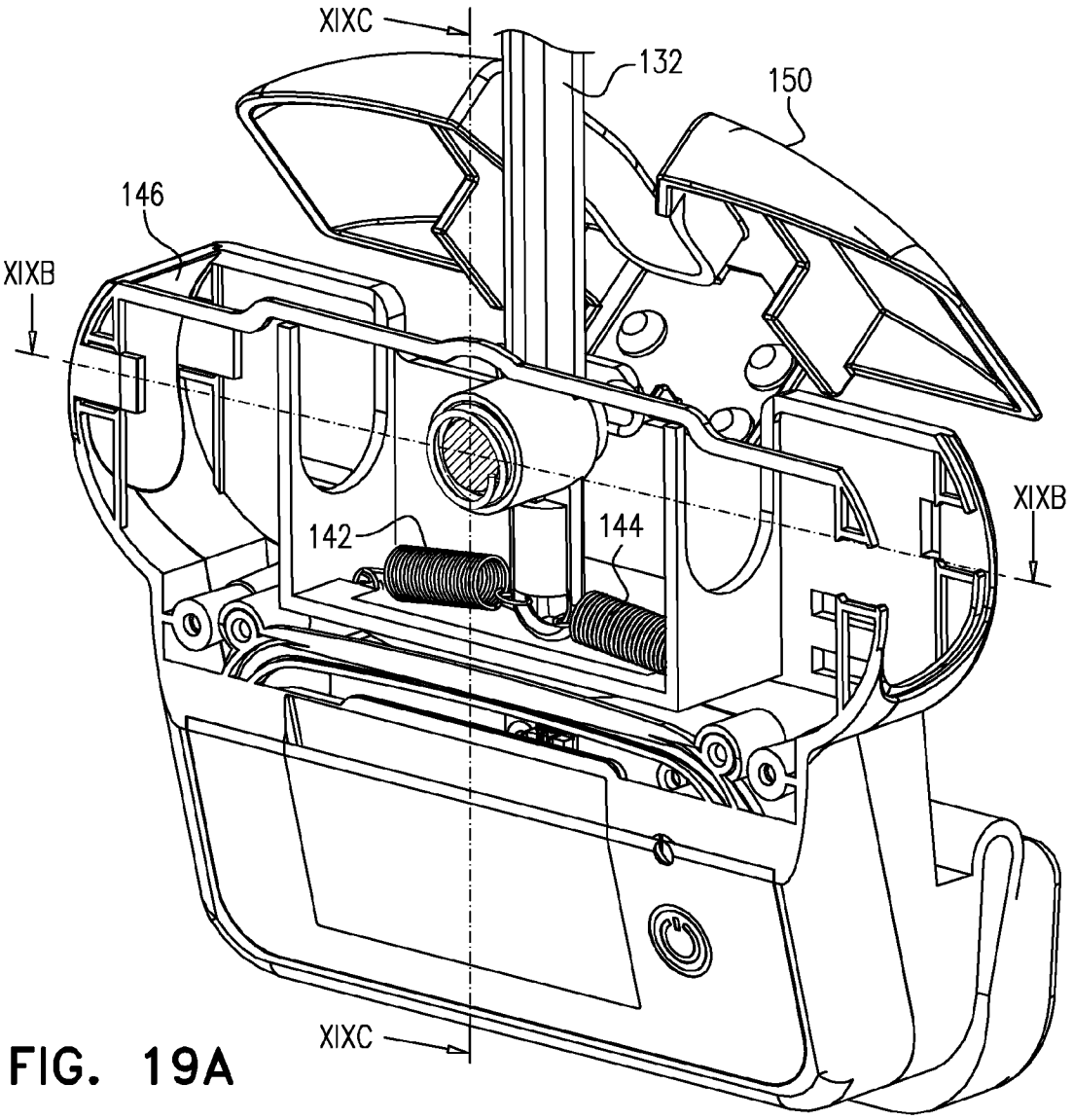
FIGS. 19A, 19B, 19C and 19D are simplified respective partially cut-away pictorial and first and second sectional illustrations of the vehicle-mountable child protective device of FIGS. 1A-2B in a fifth operative orientation, FIGS. 19B and 19C being taken along respective lines XIXB-XIXB and XIXC-XIXC in FIG. 19A and FIG. 19D being taken along respective lines XIXD-XIXD in FIG. 17C.
Figure 19B:
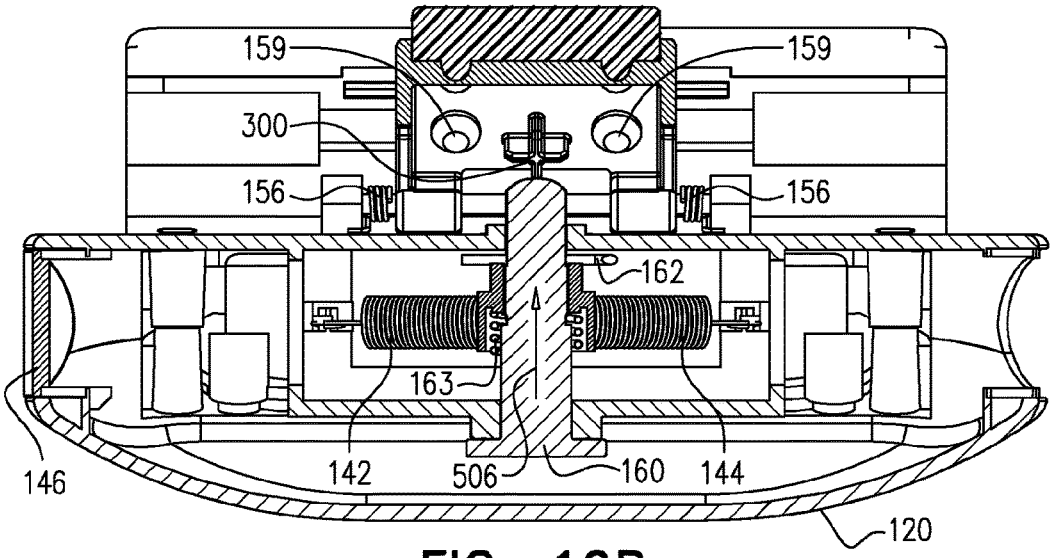

As distinguished from the operative orientation of FIGS. 18A-18C, flagpole 132 is no longer retained in a raised operative orientation by being located in upright flagpole retaining slot 310 of cover member 150. It is noted that, that as seen in FIG. 19B, when cover member 150 is rotated to the open raised operative orientation and pin engagement protrusion 300 thereof (FIG. 5C) is no longer in engagement with cover member engagement end 164 of pin 160, pin 160 is linearly displaced, under the urging of retaining pin coil spring 163 and as indicated by an arrow 506, axially along pin axis 480 to a position wherein cam riding protrusion 484 of pin 160 is located between inclined surfaces of oppositely directed circumferentially extending inclined cam surfaces 253.

Figure 19C:
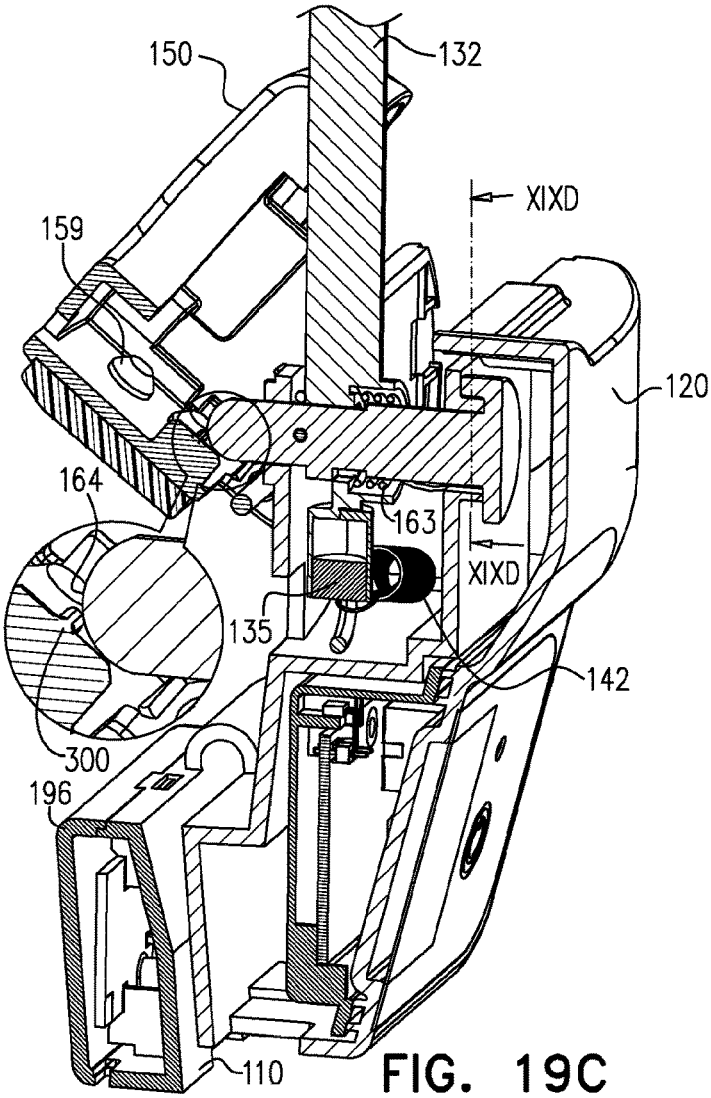
Figure 19D:
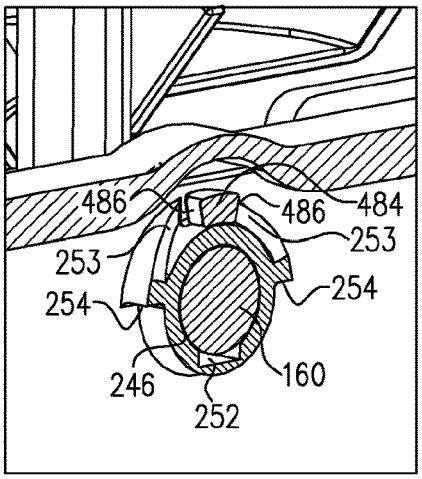
Figure 20:
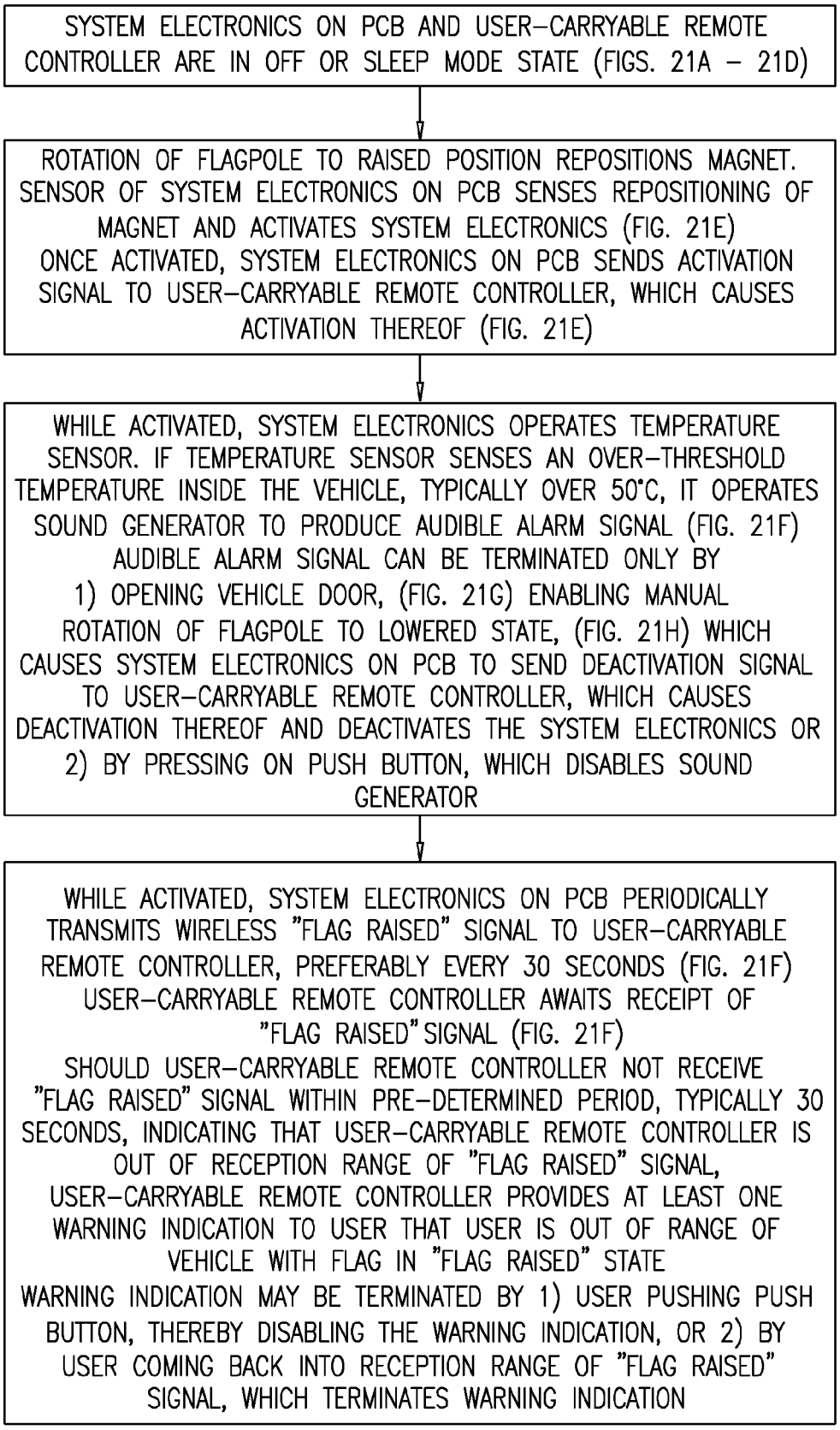
FIG. 20 is a simplified flow chart of the operation of system electronics forming part of the vehicle-mountable child protective device of FIGS. 1A-2B.

Reference is now made to FIG. 20, which is a simplified flow chart of the operation of system electronics forming part of the vehicle-mountable child protective device of FIGS. 1A-2B, and to FIGS. 21A, 21B, 21C, 21D, 21E, 21F, 21G, 21H and 21I, which are simplified pictorial illustrations of nine typical stages in the use and operation of the vehicle-mountable child protective device of FIGS. 1A-19D.

Figure 21A:
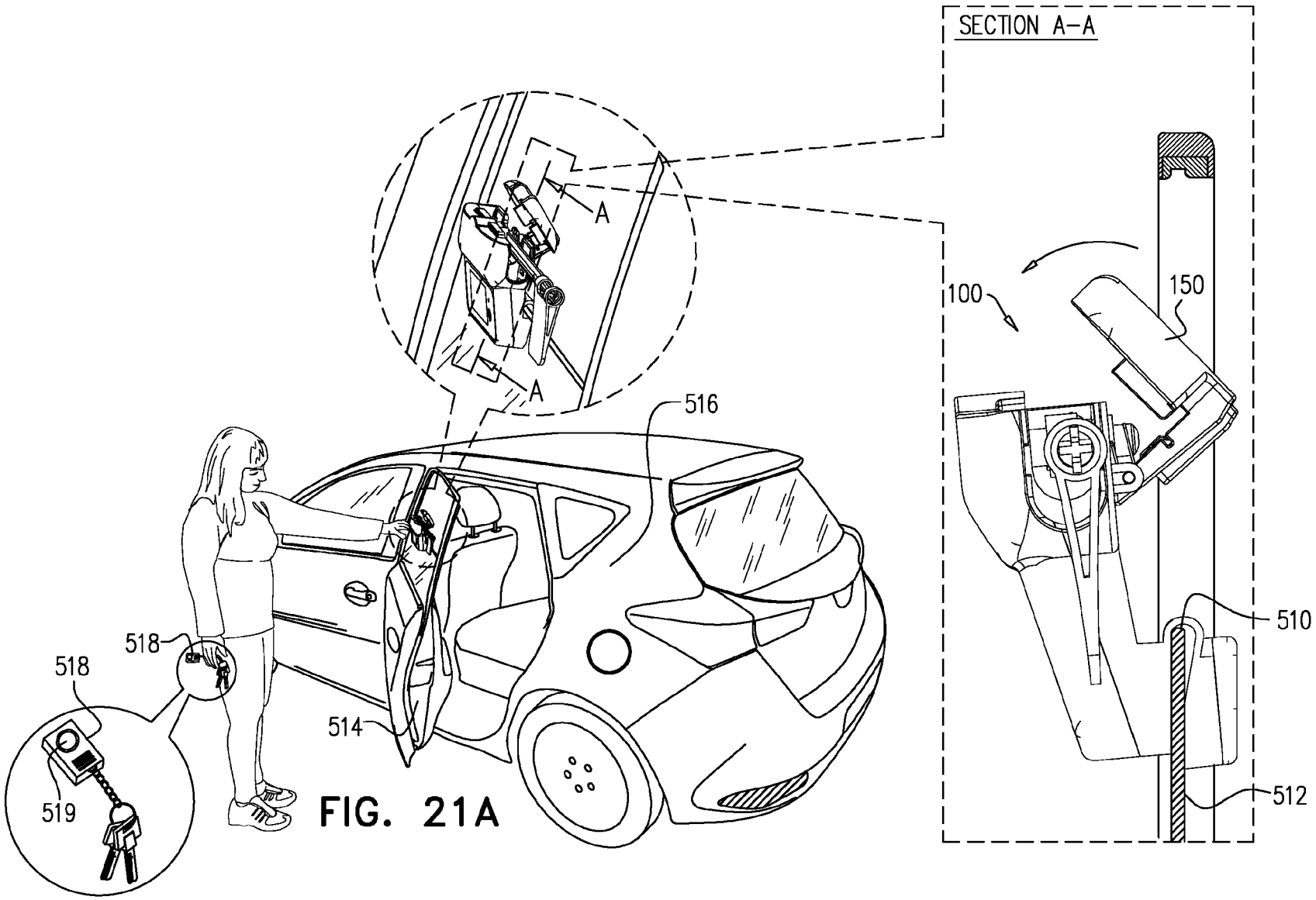
FIGS. 21A, 21B, 21C, 21D, 21E, 21F, 21G, 21H and 21I are simplified pictorial illustrations of nine typical stages in the use and operation of the vehicle-mountable child protective device of FIGS. 1A-19.

FIG. 21A shows initially installation of mounting of the vehicle-mountable child protective device 100 onto a vehicle. As seen in FIG. 21A, preferably, the vehicle-mountable child protective device 100 is mounted onto the top edge 510 of a window 512 of a door 514 of a vehicle 516. The vehicle-mountable child protective device 100 is in its first operative orientation as shown in FIGS. 15A-15D. Preferably, a user is carrying a user-carryable remote controller 518. User-carryable remote controller 518 may be any suitable user-carryable remote controller 518 and is typically a Keychain fob remote controller commercially available from Freshpoint Security Solutions of 1595 Spring Hill Road, Vienna, Va. 22182 USA.

User-carryable remote controller 518 preferably includes a buzzer, a tactile vibration generator, at least one LED light source, an RF transceiver, preferably operating at 433 MHz, a programmable microprocessor and at least one push button 519.

In this operative orientation and preferably in all operative orientations, the solar energy generating array 180 provides electricity to the system electronics.

In the operative orientation of FIG. 21A, both the system electronics on PCB 172 and the user-carryable remote controller 518 are in an OFF or sleep mode state.

Figure 21B:
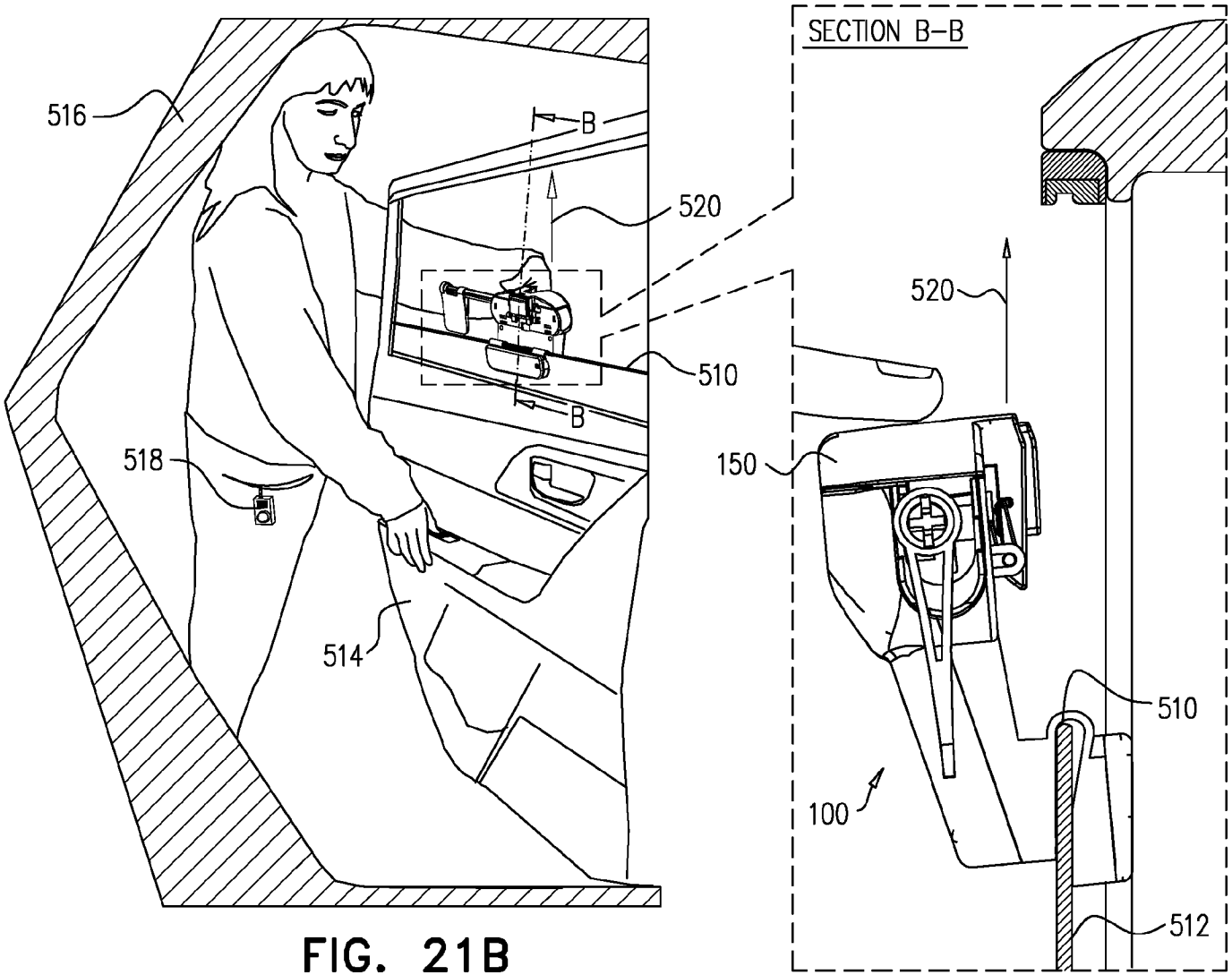

FIG. 21B shows a user closing the window, as indicated by an arrow 520, preferably while holding the cover member 150 in the closed lowered operative orientation, retaining the flagpole 132 in a lowered orientation. The vehicle-mountable child protective device 100 is in its second operative orientation as shown in FIGS. 16A-16D.

In the operative orientation of FIG. 21B, both the system electronics on PCB 172 and the user-carryable remote controller 518 remain in an OFF or sleep mode state.

Figure 21C:
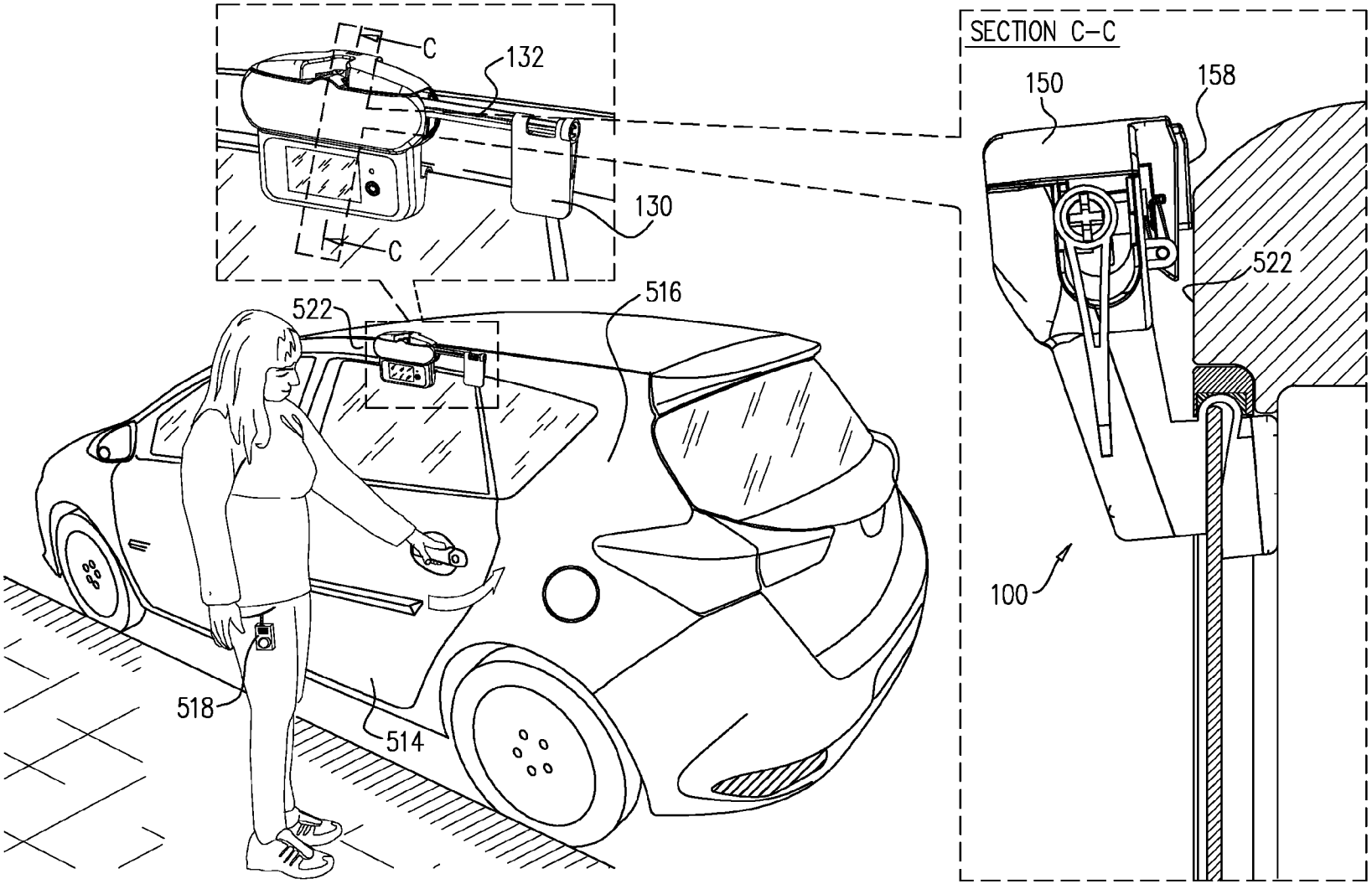

FIG. 21C shows the vehicle door 514 being closed, with vehicle-mountable child protective device 100 mounted onto vehicle 516, with the flagpole 132 being retained in a lowered operative orientation by the cover member 150, which, in turn, is retained in the closed lowered operative orientation by engagement of vehicle engagement pad 158, mounted onto cover member 150, with a side panel 522 of vehicle 516. The vehicle-mountable child protective device 100 is in its second operative orientation as shown in FIGS. 16A-16D.

In the operative orientation of FIG. 21C, both the system electronics on PCB 172 and the user-carryable remote controller 518 remain in an OFF or sleep mode state.

Figure 21D:
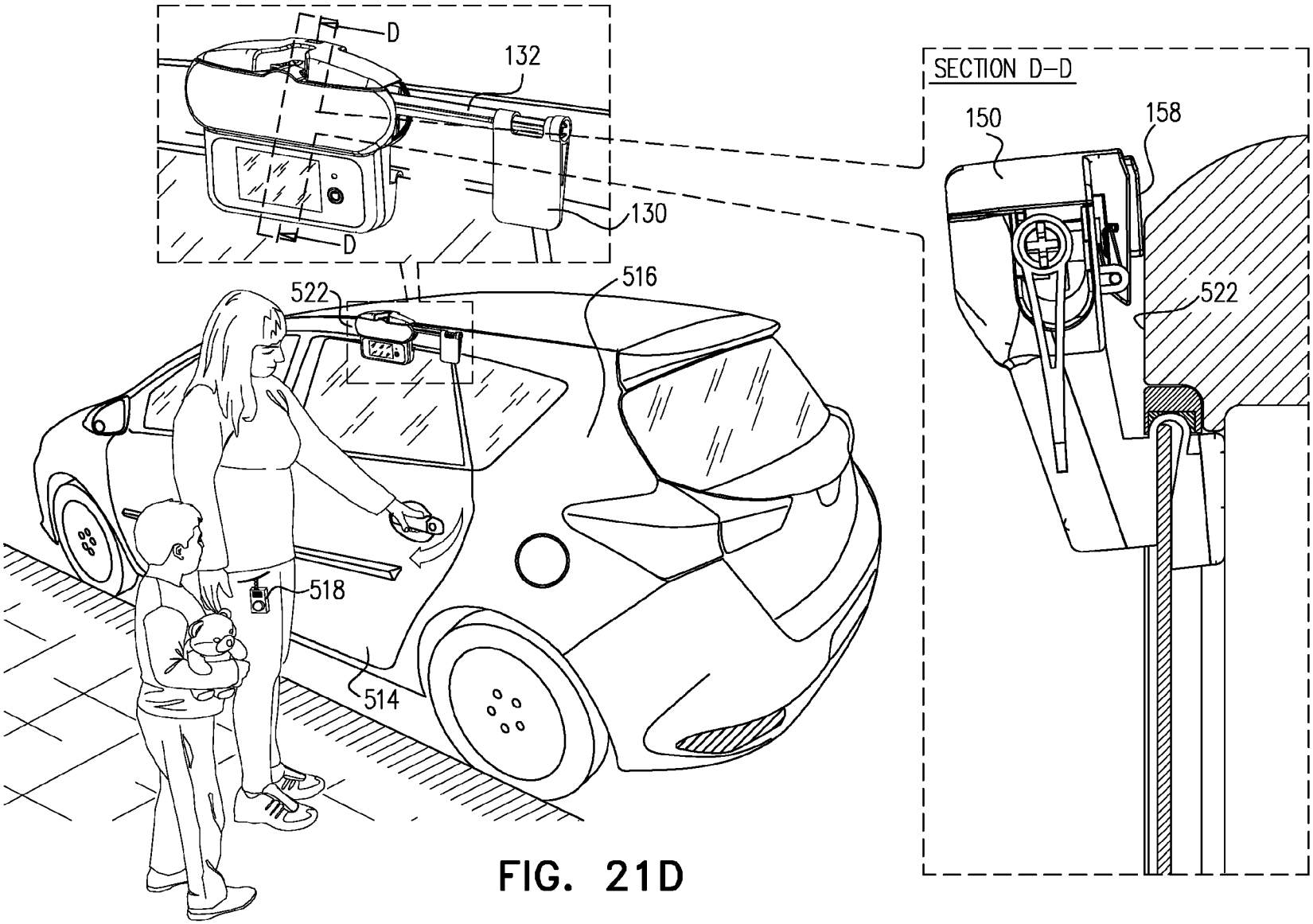

FIG. 21D shows the vehicle door 514 about to be opened, with vehicle-mountable child protective device 100 mounted onto vehicle 516, with the flagpole 132 being retained in a lowered operative orientation by the cover member 150, which, in turn, is retained in the closed lowered operative orientation by engagement of vehicle engagement pad 158, mounted onto cover member 150, with side panel 522 of vehicle 516. The vehicle-mountable child protective device 100 is in its second operative orientation as shown in FIGS. 16A-16D.

In the operative orientation of FIG. 21D, both the system electronics on PCB 172 and the user-carryable remote controller 518 remain in an OFF or sleep mode state.

Figure 21E:
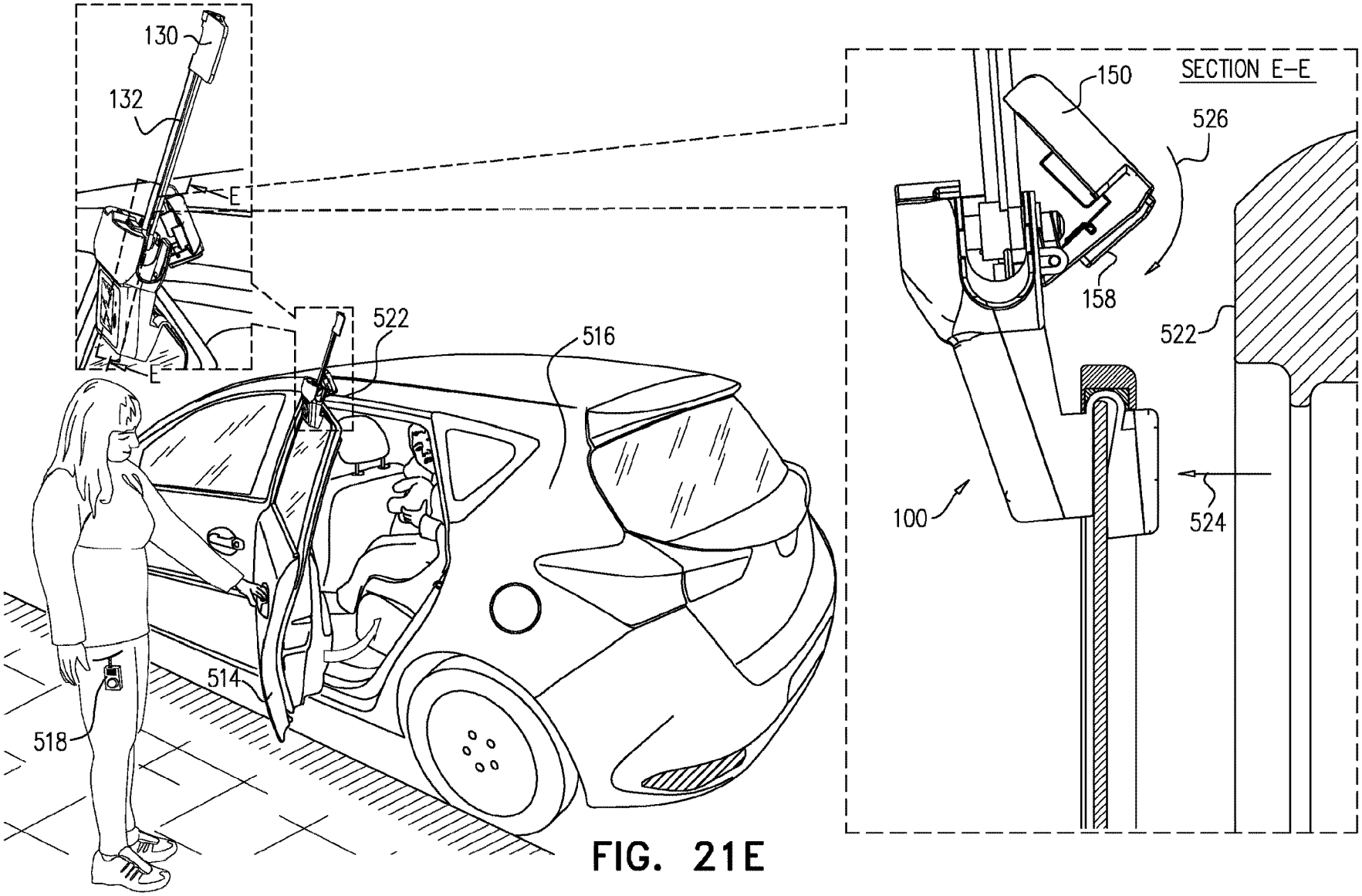

FIG. 21E shows opening of the vehicle door 514, as indicated by an arrow 524, and seating of a child in the vehicle. Opening of the vehicle door 514 causes vehicle engagement pad 158 to disengage from side panel 522 of vehicle 516, thereby causing cover member 150 to rotate from the closed lowered operative orientation, shown in FIGS. 15A-15D, to the open raised operative orientation, shown in FIGS. 17A 17D, as indicated by an arrow 526, under the urging of springs 156. Rotation of cover member 150 to the open raised operative orientation allows flagpole 132 to automatically rotate to its raised position under the urging of flag positioning spring 144, positioning flag 130 in a raised position above the level of the roof of the vehicle. The vehicle-mountable child protective device 100 is in its third operative orientation as shown in FIGS. 17A-17D.

Rotation of the flagpole 132 repositions magnet 135, which repositioning is sensed by the magnet propinquity sensor 175 of the system electronics on PCB 172. Rotation of the flagpole 132 to its raised operative orientation thus activates user-carryable remote controller 518 and sends a system electronics activation notification to the user-carryable remote controller 518. The system electronics periodically transmits a "flag raised" signal to the user-carryable remote controller 518, preferably every 30 seconds.

Once activated, the user-carryable remote controller 518 awaits a flag raised signal from the system electronics typically every 30 seconds. Should such a flag raised signal from the system electronics not arrive within typically 30 seconds, indicating that the user has left the immediate vicinity of the vehicle 516, typically 10-15 meters from the vehicle 516, the user-carryable remote controller 518 provides a tactile or audible indication to the user. This indication may be terminated by a user lowering the flag 130, which requires opening of the vehicle door 514, thereby deactivating the system electronics, or by pressing on button 519 on the user-carryable remote controller 518.

The foregoing feature ensures that once the flag is raised the user cannot leave the vicinity of the vehicle 516 without either reopening the vehicle door 514 or pressing on button 519 on the user-carryable remote controller 518.

Once activated and until deactivated by lowering of the flag 130, the system electronics conducts a vehicle interior temperature check, preferably every minute. In the event of a threshold temperature, typically 50° C., at the vehicle interior being exceeded, an audible alarm is produced by the system electronics. The alarm may be terminated or interrupted by either rotating the flag 130 to a lowered operative orientation or by pressing on flexible portion 184 thereby operating push button 176. Lowering of the flag 130 causes a system electronics deactivation notification to be sent to the user-carryable remote controller 518.

Figure 21F:
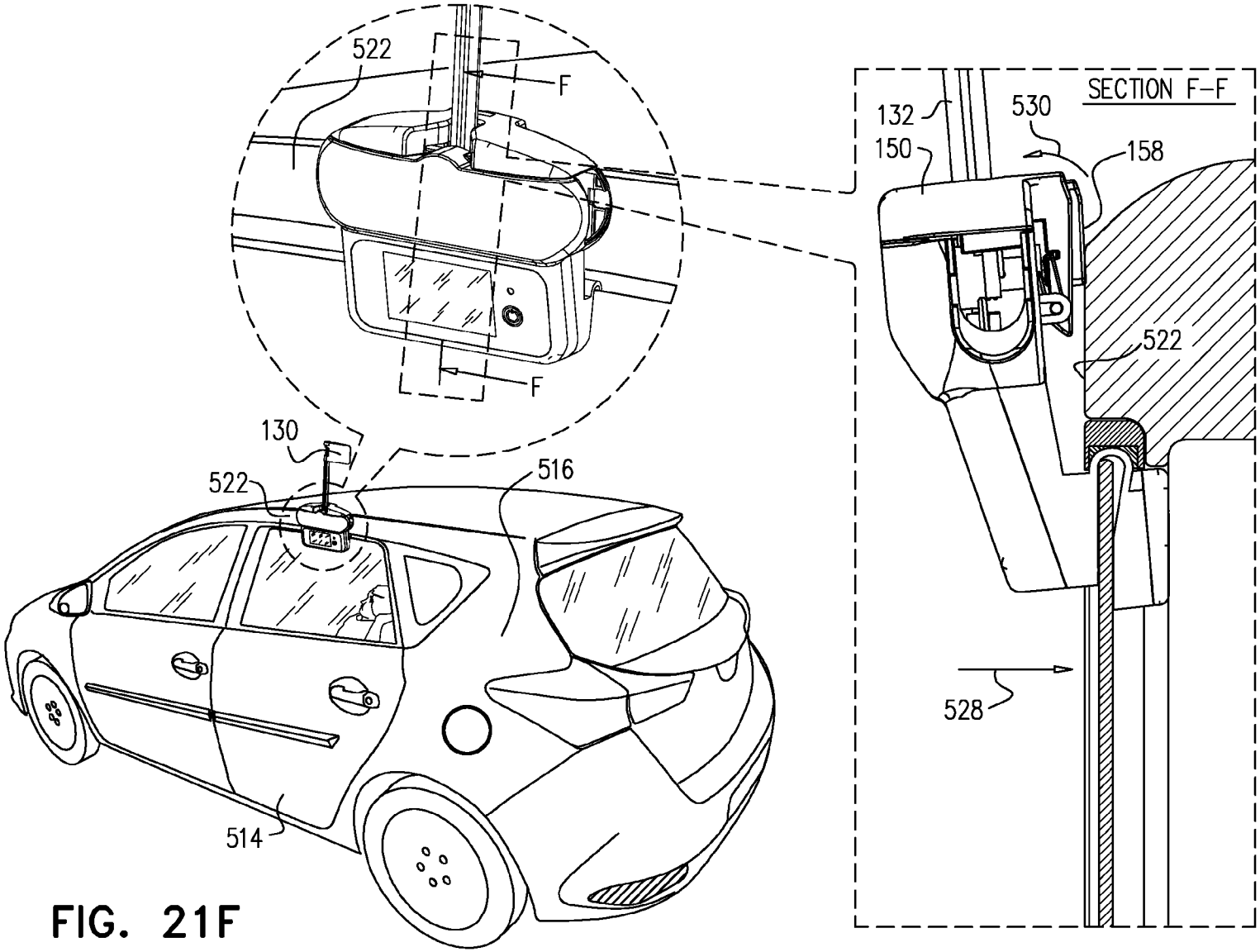

FIG. 21F shows closing of the vehicle door 514, as indicated by an arrow 528, with the child inside the vehicle. Closing of the vehicle door 514 causes vehicle engagement pad 158 to engage from side panel 522 of vehicle 516 thereby rotating cover member 150, as indicated by an arrow 530, to the closed lowered operative orientation. The flag 130 is retained in its raised position above the level of the roof of the vehicle. The vehicle-mountable child protective device 100 is in its fourth operative orientation as shown in FIGS. 18A-18C. The flag 130 cannot be lowered without opening the vehicle door 514.

Figure 21G:
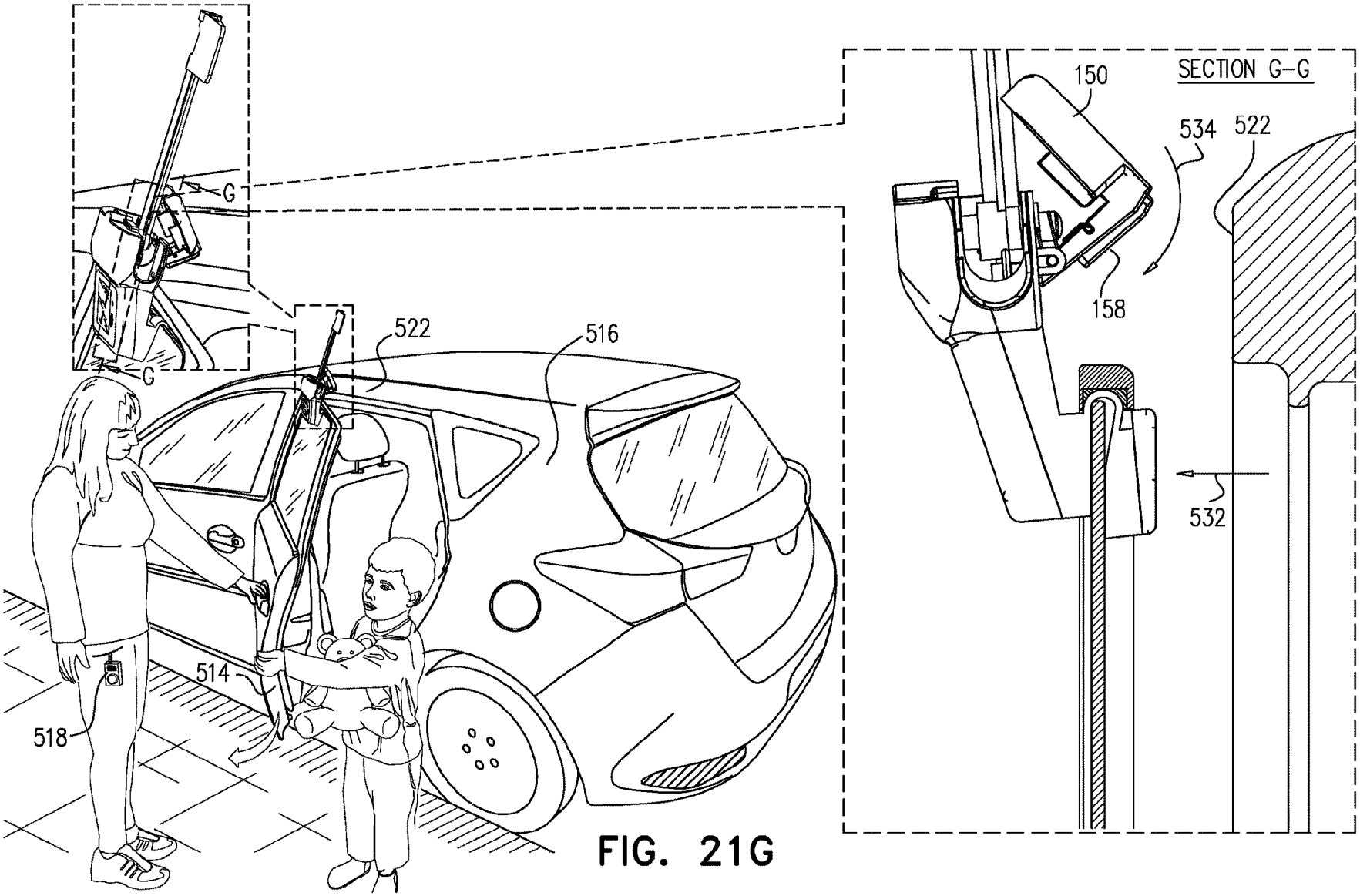

FIG. 21G shows opening the vehicle door 514, as indicated by an arrow 532, and the child leaving the vehicle. Opening of the vehicle door 514 causes vehicle engagement pad 158 to disengage from side panel 522 of vehicle 516, thereby rotating cover member 150, as indicated by an arrow 534, from the closed lowered operative orientation seen in FIG. 21F to the open raised operative orientation. The flag 130 remains in its raised position above the level of the roof of the vehicle but may be manually rotated to a lowered operative orientation. The vehicle-mountable child protective device 100 is in its fifth operative orientation as shown in FIGS. 19A-19C.

Figure 21H:
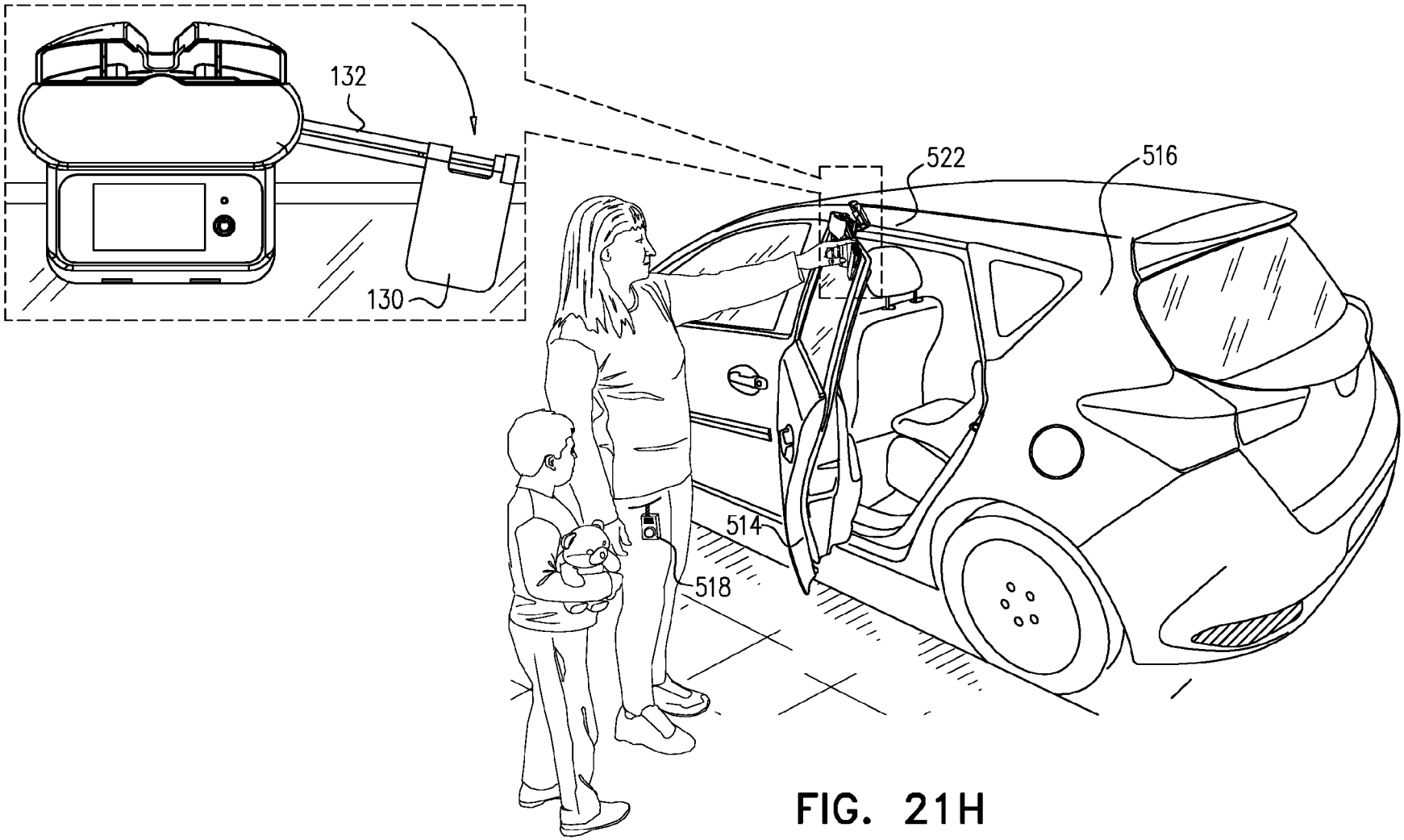

FIG. 21H shows manual rotation of the flag 130 to its lowered position while the door is open and the child is outside the vehicle. The vehicle-mountable child protective device 100 is in its first operative orientation as shown in FIGS. 15A-15D.

Figure 21I:
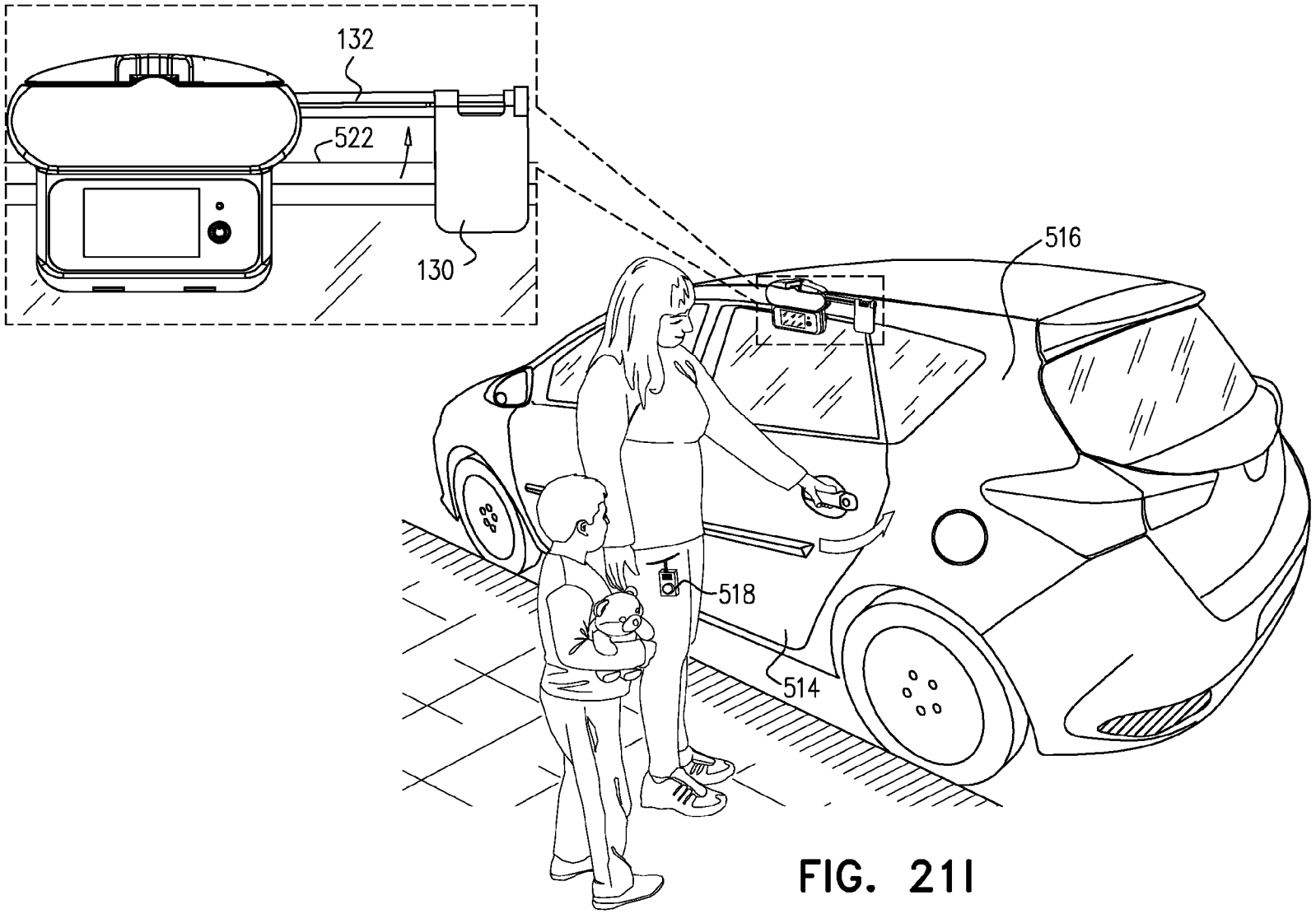

FIG. 21I shows closing of the vehicle door 514 after manual rotation of the flag 130 to its lowered position. The vehicle-mountable child protective device 100 is again in its second operative orientation as shown in FIGS. 16A-16D.

It will be appreciated by persons skilled in the art that the present invention is not limited by what has been particularly shown and described hereinabove, rather the scope of the present invention includes both combinations and subcombinations of various features described hereinabove and modifications thereof which would occur to persons reading the foregoing description and which are not in the prior art

The invention claimed is:

1. A vehicle-mountable child protective device comprising:

a housing which is mountable onto a vehicle; and a child protective assembly mounted in said housing and being automatically operative to assume a potential warning state upon opening and subsequent closing of a door of said vehicle, said child protective assembly being manually operable by a user for causing said child protective assembly to no longer be in said potential warning state;

electronic circuitry operative to provide a user-sensible warning to a user who is located at a distance greater than a predetermined distance from said vehicle when said assembly is in said potential warning state; and temperature exceedance electronic circuitry operative to provide an audible warning when a temperature within said vehicle is greater than a predetermined threshold, when said assembly is in said potential warning state.

2. A vehicle mountable child protective device according to claim 1 and also comprising a solar energy generating array mounted on said housing and being exposed to solar radiation from outside said vehicle.

3. A vehicle-mountable child protective device according to claim 1 and wherein said child protective assembly is operative to prevent said user from causing said assembly to no longer be in said potential warning state without first reopening said door of said vehicle.

4. A vehicle-mountable child protective device according to claim 1 and wherein said user-sensible warning comprises at least one of a tactile indication and an audible indication.

5. A vehicle-mountable child protective device:

a housing which is mountable onto a vehicle; and a child protective assembly mounted in said housing and being automatically operative to assume a potential warning state upon opening and subsequent closing of a door of said vehicle, said child protective assembly being manually operable by a user for causing said assembly to no longer be in said potential warning state; and temperature exceedance electronic circuitry operative, when said child protective assembly is in said potential warning state, to provide an audible warning when a temperature within said vehicle is greater than a predetermined threshold.

6. A vehicle mountable child protective device according to claim 5 and also comprising a solar energy generating array mounted on said housing and being exposed to solar radiation from outside said vehicle.

7. A vehicle-mountable child protective device according to claim 5 and wherein said child protective assembly is operative to prevent said user from causing said assembly to no longer be in said potential warning state without first reopening said door of said vehicle.

8. A vehicle-mountable child protective device comprising:

a housing which is mountable onto the vehicle;

a child protective assembly mounted in said housing and being automatically operative to assume a potential warning state upon opening and subsequent closing of a door of said vehicle, said child protective assembly being manually operable by a user for causing said assembly to no longer be in said potential warning state; and system electronics, said system electronics including temperature exceedance electronic circuitry operative to provide an audible warning when a temperature within said vehicle is greater than a predetermined threshold, when said assembly is in said potential warning state, said system electronics of said vehicle-mountable child protective device and a user-carryable remote controller being in an OFF or sleep mode state upon initial mounting of said vehicle-mountable child protective device onto said vehicle.

9. A vehicle-mountable child protective device according to claim 8 and wherein when said child protective assembly assumes said potential warning state said system electronics sends a system electronics activation notification to said user-carryable remote controller.

10. A vehicle-mountable child protective device according to claim 8 and wherein when said child protective assembly is in said potential warning state, said system electronics periodically transmits a potential warning state signal to said user-carryable remote controller.

11. A vehicle-mountable child protective device according to claim 8 and wherein once activated, said user-carryable remote controller awaits a potential warning state signal from said system electronics and in the absence of a received potential warning state signal, which absence indicates that the user has left the immediate vicinity of the vehicle, said user-carryable remote controller provides a user-sensible indication, thereby ensuring that when said vehicle-mountable child protective device is in said potential warning state the user is reminded not to leave the vicinity of the vehicle without either reopening the vehicle door or taking other action to terminate said user-sensible indication.

12. A vehicle-mountable child protective device according to claim 11 and wherein said user-sensible indication comprises at least one of a tactile indication and an audible indication.

13. A vehicle-mountable child protective device according to claim 8 and wherein said temperature exceedance electronic circuitry, once activated and until deactivated by manual operation of said user, conducts a vehicle interior temperature check and in the event of exceedance of said predetermined threshold provides said audible warning.

14. A vehicle-mountable child protective device according to claim 8 and wherein said child protective assembly is operative to prevent said user from causing said assembly to no longer be in said potential warning state without first reopening said door of said vehicle.

* * * * *